US012698061B2

(12) United States Patent
Oda et al.

(10) Patent No.: US 12,698,061 B2
(45) Date of Patent: Aug. 4, 2026

(54) FISHING SHIP ACTIVITY ESTIMATION DEVICE AND FISHING SHIP ACTIVITY ESTIMATION PROGRAM

(71) Applicants: Meta Systems Laboratories, Inc., Kagoshima (JP); Ocean Solution Technology Kabushiki Kaisha, Nagasaki (JP)

(72) Inventors: Kentaro Oda, Kagoshima (JP); Tomohiro Matsuo, Kagoshima (JP); Yosuke Mizukami, Nagasaki (JP)

(73) Assignees: Meta Systems Laboratories, Inc., Kagoshima (JP); Ocean Solution Technology Kabushiki Kaisha, Nagasaki (JP)

( * ) Notice: Subject to any disclaimer, the term of this patent is extended or adjusted under 35 U.S.C. 154(b) by 0 days.

(21) Appl. No.: 19/111,240

(22) PCT Filed: Sep. 5, 2023

(86) PCT No.: PCT/JP2023/032315
§ 371 (c)(1),
(2) Date: Mar. 12, 2025

(87) PCT Pub. No.: WO2024/057997
PCT Pub. Date: Mar. 21, 2024

(65) Prior Publication Data

US 2026/0008522 A1 Jan. 8, 2026

(30) Foreign Application Priority Data

Sep. 15, 2022 (JP) ..... 2022-147362

(51) Int. Cl.
*B63B 35/14* (2006.01)
*B63B 79/20* (2020.01)
*B63B 79/40* (2020.01)

(52) U.S. Cl.
CPC ..... *B63B 35/14* (2013.01); *B63B 79/20* (2020.01); *B63B 79/40* (2020.01)

(58) Field of Classification Search
CPC .. A61K 48/00; A61K 48/005; A61K 31/7088; A61K 31/7105; A61K 38/00;
(Continued)

(56) References Cited

U.S. PATENT DOCUMENTS 5,838,227 A * 11/1998 Murray ..... B63J 99/00 340/539.11
7,937,884 B1 * 5/2011 Naylor ..... A01K 97/06 206/315.11

(Continued)

FOREIGN PATENT DOCUMENTS

CN 109840358 A 6/2019
CN 114139608 A 3/2022

(Continued)

OTHER PUBLICATIONS

International Search Report and Written Opinion, mailed Nov. 28, 2023, for International Patent Application Serial No. PCT/JP2023/032315 filed on Sep. 5, 2023 (English translation provided).

(Continued)

*Primary Examiner* — Daniel Previl
(74) *Attorney, Agent, or Firm* — K&L Gates LLP; Brian J. Novak; Giorgios N. Kefallinos

(57) ABSTRACT

A velocity feature-vector data acquirer (225) acquires velocity feature vector data (SVF) containing detected velocity data (SV) indicating a chronological series of velocities of a fishing craft and velocity dispersion data (SVb) indicating a chronological series of dispersions of the velocities of the fishing craft. An activity estimator (241) executes, based on the velocity feature vector data (SVF), an activity identifying process for identifying whether the fishing craft is during (Continued)

travel or fishing operation, and outputs activity identification result data (AD) indicating a chronological series of identification results in the activity identifying process.

13 Claims, 19 Drawing Sheets

(58) Field of Classification Search
CPC .... A61K 45/06; A61K 39/00; A61K 48/0075; A61K 9/0014; A61K 9/0019; C07K 14/505; C07K 14/00; C12N 15/113; C12N 2310/531; A61B 5/0002; A61B 5/024; A61B 5/02405; A61B 5/02444; A61B 5/0245; A61B 5/05; A61B 5/0507; A61B 5/0816; A61B 5/11; A61B 5/1113; A61B 5/1118; A61B 5/112; A61B 5/1126; A61B 5/113; A61B 5/165; A61B 5/4806; A61B 5/6898; A61B 5/7207; A61B 5/7246; A61B 5/746; G01S 13/003; G01S 13/56; G01S 7/415; G01S 13/32; G01S 13/66; G01S 13/726; G01S 13/867; G01S 13/92; G01S 15/89; G01S 19/14; G01S 17/18; G01S 17/89; Y02A 50/30; G01N 2021/653; G01N 2021/655; G01N 21/6458; G01N 21/65; G01V 1/28; G01V 1/36; G01V 2210/44; G01V 2210/51; G01V 2210/679; G01V 1/3808; G01V 1/3826; G01V 1/181; G01V 1/186; G01V 1/226; G01V 1/288; G01V 1/34; G01V 1/364; G01V 2210/1421; G01V 2210/144; G01V 2210/324; G02B 21/0032; G02B 21/0036; G02B 21/0064; G02B 21/0076; G02B 6/022; G02B 6/02204; G02B 6/278; G02B 6/2932; G02B 6/4246; H04B 10/2569; B63B 49/00; B63B 79/20; B63B 79/40; B63B 1/288; B63B 2201/26; B63B 43/18; B63B 79/00; B63B 79/10; B63B 1/248; B63B 1/38; B63B 1/107; B63B 1/246; B63B 2001/345; B63B 35/14; G01C 13/008; G01C 21/203; G01C 21/20; G01C 21/22; G01C 21/3881; G01C 5/00; G01C 21/1656; G01C 21/30; G01C 21/3647; H04W 24/02; H04W 48/18; H04W 28/0247; H04W 28/0846; H04W 36/008375; H04W 36/1446; H04W 36/22; H04W 48/16; A63F 13/20; A63F 13/63; B60L 15/2045; B60L 2200/32; B60L 2240/12; B60L 2240/62; B60L 2240/622; B60L 2240/66; B60L 2250/10; B60L 2250/16; B60L 2260/52; B60L 2260/54; B60L 50/60; B60L 58/12; B60L 8/003; B60L 8/006; B63G 8/38; B63G 8/08; B63G 8/26; G08G 3/00; G08G 3/02; Y02T 10/64; Y02T 10/7072; Y02T 70/10; Y10S 367/909; B63H 1/36; B63H 16/20; B63H 2016/085; B63H 1/12; B63H 11/08; B63H 11/103; B63H 2001/122; B63H 2023/005; B63H 2025/026; B63H 21/213; B63H 25/02; B63H 5/00; B63H 5/14; G04R 20/02; G05D 1/0206; G05D 1/0293; G05D 1/104; G06F 16/287; G06F 3/016; G06F 3/017; G06F 13/1694; G06N 20/20; G06N 3/044; G06N 3/0442; G06N 3/08; G06N 3/084; G06N 3/09; G06N 3/0985; G06N 5/01; G06N 5/022; H05K 7/20509; H10W 40/22; H10W 40/641; H10W 40/70; H10W 90/722; H10W 90/724; F41G 3/22; F41G 5/06; F41G 5/16; F41G 5/24; F42B 10/38; F42B 19/125; G01B 11/162; G06Q 50/02; G11C 11/4063; G11C 2029/0409; G11C 29/44; G11C 29/808; G11C 5/06; G11C 7/10
USPC ..... 340/984, 425.5, 426, 539, 604, 506, 340/828.06, 605, 693, 573
See application file for complete search history.

(56) References Cited

U.S. PATENT DOCUMENTS

| | | | | |
|---|---|---|---|---|
| 10,185,046 | B2 * | 1/2019 | Anderson | G01V 1/28 |
| 10,769,440 | B1 | 9/2020 | Zhang et al. | |
| 2005/0032527 | A1 * | 2/2005 | Sheha | H04M 1/2746 455/457 |
| 2006/0047692 | A1 * | 3/2006 | Rosenblum | G06F 16/48 707/999.102 |
| 2009/0167592 | A1 * | 7/2009 | Kao | G01S 7/021 342/41 |
| 2011/0099163 | A1 * | 4/2011 | Harris | G06F 16/907 707/723 |
| 2017/0334535 | A1 * | 11/2017 | Coller | B63H 20/32 |
| 2020/0302187 | A1 * | 9/2020 | Wang | G06V 20/52 |
| 2022/0003554 | A1 | 1/2022 | Senzaki | |
| 2022/0317238 | A1 | 10/2022 | Senzaki | |

FOREIGN PATENT DOCUMENTS

| | | | |
|---|---|---|---|
| JP | 2012-021896 | A | 2/2012 |
| JP | 2018-055269 | A | 4/2018 |
| JP | 2021-157722 | A | 10/2021 |
| KR | 101958168 | B1 | 3/2019 |
| KR | 2022-0025573 | A | 3/2022 |
| WO | 2020/157964 | A1 | 8/2020 |
| WO | 2024/057997 | A1 | 3/2024 |

OTHER PUBLICATIONS

Extended European Search Report (EESR) dated Feb. 4, 2026, issued in corresponding European Patent Application No. 23865352.1.

Huang, Haiguang et al., "FVID: Fishing Vessel Type Identification Based on VMS Trajectories", J. Ocean Univ. China (Oceanic and Coastal Sea Research), 2019, vol. 18, No. 2, pp. 403-412.

* cited by examiner

FISHING SHIP ACTIVITY ESTIMATION DEVICE AND FISHING SHIP ACTIVITY ESTIMATION PROGRAM

CROSS REFERENCE TO RELATED APPLICATION(S)

This application is a national phase filing of International Application Serial No. PCT/JP2023/032315, filed on Sep. 5, 2023, which claims the benefit of priority to Japanese Patent Application Serial No. 2022-147362, filed on Sep. 15, 2022, the entire disclosures each of which are incorporated herein by reference.

TECHNICAL FIELD

The present disclosure relates to a fishing-craft activity estimating apparatus and a fishing-craft activity estimating program.

BACKGROUND ART

Some systems have been known for facilitating generation of report data indicating fishing achievements, an example of which is disclosed in Patent Literature 1. Such a system identifies the location of a fishing operation, on the basis of chronological data indicating locations of a fishing craft during a navigation. The report data contains data indicating the location of the fishing operation.

The "fishing operation" in this specification means an operation for catching fishery resources with fishing gears, such as fishing nets and fishing rods, on a fishing craft.

CITATION LIST

Patent Literature

Patent Literature 1: Unexamined Japanese Patent Application Publication No. 2021-157722

SUMMARY OF INVENTION

Technical Problem

The fishing craft alternately repeats fishing operations in fisheries and travels to subsequent fisheries during a navigation. The system disclosed in Patent Literature 1 is not able to precisely classify the period of navigation of the fishing craft into subperiods of fishing operations and subperiods of travels of the fishing craft. The system disclosed in Patent Literature 1 thus cannot acquire the efficiency of fishing, specifically, the amount of fish catch per unit time in a fishing operation.

The efficiency of fishing needs to be acquired in some cases, for the purpose of protection of fishery resources. A reduction in the efficiency of fishing implies a decrease in fishery resources due to overfishing. Such a reduction in the efficiency of fishing should be followed by measures of refraining from fishing, which leads to prevention of depletion of fishery resources.

The efficiency of fishing could be readily acquired on the basis of activity identification result data indicating a chronological series of results of identification of whether the fishing craft is during travel or fishing operation. The activity identification result data contributes to determination of the net length (hereinafter referred to as "net length of the fishing periods") of the period actually required by the fishing operations during the navigation of the fishing craft. Specifically, the efficiency of fishing can be calculated by dividing the amount of fish catch by the net length of the fishing periods.

Although the activity identification result data is used to acquire the efficiency of fishing in the above-described example, the activity identification result data may also be used for other purposes. The activity identification result data may be used to acquire the details of activities of the fishing craft, for example. The present disclosure has been accomplished in view of these situations.

An objective of the present disclosure is to provide a fishing-craft activity estimating apparatus and a fishing-craft activity estimating program that can acquire activity identification result data indicating a chronological series of results of identification of whether the fishing craft is during travel or fishing operation.

Solution to Problem

A fishing-craft activity estimating apparatus according to a first aspect of the present disclosure includes:

- a velocity feature-vector data acquirer to acquire velocity feature vector data containing velocity data and velocity dispersion data, the velocity data indicating a chronological series of velocities of a fishing craft that performs a fishing operation in a fishery and a travel to a destination, the velocity dispersion data indicating a chronological series of dispersions of the velocities of the fishing craft; and
- an activity estimator
  - to execute, based on the velocity feature vector data, an activity identifying process for identifying whether the fishing craft is during travel or fishing operation, and
  - to output activity identification result data indicating a chronological series of identification results in the activity identifying process.

A fishing-craft activity estimating apparatus according to a second aspect of the present disclosure includes:

- an angular-speed feature-vector data acquirer to acquire angular-speed feature vector data containing angular speed data and angular speed dispersion data, the angular speed data indicating a chronological series of angular speeds of rocking motions of a fishing craft during a navigation, the angular speed dispersion data indicating a chronological series of dispersions of the angular speeds, the fishing craft performing a fishing operation in a fishery and a travel to a destination; and
- an activity estimator
  - to execute, based on the angular-speed feature vector data, an activity identifying process for identifying whether the fishing craft is during travel or fishing operation, and
  - to output activity identification result data indicating a chronological series of identification results in the activity identifying process.

A fishing-craft activity estimating apparatus according to a third aspect of the present disclosure includes:

- an acceleration feature-vector data acquirer to acquire acceleration feature vector data containing acceleration data and acceleration dispersion data, the acceleration data indicating a chronological series of accelerations of a fishing craft that performs a fishing operation in a fishery and a travel to a destination, the acceleration dispersion data indicating a chronological series of dispersions of the accelerations of the fishing craft; and an activity estimator to execute, based on the acceleration feature vector data, an activity identifying process for identifying whether the fishing craft is during travel or fishing operation, and to output activity identification result data indicating a chronological series of identification results in the activity identifying process.

A fishing-craft activity estimating apparatus according to a fourth aspect of the present disclosure includes:

a velocity feature-vector data acquirer to acquire velocity feature vector data containing velocity data and velocity dispersion data, the velocity data indicating a chronological series of velocities of a fishing craft that performs a fishing operation in a fishery and a travel to a destination, the velocity dispersion data indicating a chronological series of dispersions of the velocities of the fishing craft;

an angular-speed feature-vector data acquirer to acquire angular-speed feature vector data containing angular speed data and angular speed dispersion data, the angular speed data indicating a chronological series of angular speeds of rocking motions of the fishing craft during a navigation, the angular speed dispersion data indicating a chronological series of dispersions of the angular speeds; and an activity estimator to execute, based on the velocity feature vector data and the angular-speed feature vector data, an activity identifying process for identifying whether the fishing craft is during travel or fishing operation, and to output activity identification result data indicating a chronological series of identification results in the activity identifying process.

According to the fishing-craft activity estimating apparatus of the fourth aspect of the present disclosure, the activity estimator may execute the activity identifying process based on, not only the velocity feature vector data and the angular-speed feature vector data, but also differentiated velocity feature-vector data and differentiated angular-speed feature-vector data, the differentiated velocity feature-vector data indicating the velocity feature vector data after temporal differentiation, the differentiated angular-speed feature-vector data indicating the angular-speed feature vector data after temporal differentiation.

According to the fishing-craft activity estimating apparatus of the fourth aspect of the present disclosure, the activity estimator may include a learned model generated by machine learning for identifying whether the fishing craft is during travel or fishing operation, the machine learning being based on the velocity feature vector data, the angular-speed feature vector data, the differentiated velocity feature-vector data, and the differentiated angular-speed feature-vector data.

The velocity feature vector data may contain velocity change rate data indicating a chronological series of rates of change in the velocities of the fishing craft, and the angular-speed feature vector data may contain angular-speed change rate data indicating a chronological series of rates of change in the angular speeds.

The velocity data may contain detected velocity data indicating a chronological series of detected velocities of the fishing craft, and smoothed velocity data being the detected velocity data after moving average, and the angular speed data may contain detected angular speed data indicating a chronological series of detected angular speeds, and smoothed angular speed data being the detected angular speed data after moving average.

The fishing-craft activity estimating apparatus of the first to fourth aspects of the present disclosure may further include a trajectory image data acquirer to acquire trajectory image data indicating a trajectory of the fishing craft during a navigation, and when the activity estimator estimates that the fishing craft is during fishing operation in the activity identifying process, the activity estimator may further execute a fishing detail estimating process for estimating details of the fishing operation from the trajectory image data.

The fishing-craft activity estimating apparatus of the first to fourth aspects of the present disclosure may further include:

a location data acquirer to acquire location data indicating locations of the fishing craft during a navigation; and a location identifier to execute, based on the location data and map data indicating a map, a location identifying process for identifying whether the fishing craft is located in a coastal region close to a land or an offshore region more distant from the land than the coastal region, when the location identifier identifies that the fishing craft is located in the offshore region in the location identifying process, the activity identifying process may be executed, and when the location identifier identifies that the fishing craft is located in the coastal region in the location identifying process, the activity identifying process may be stopped.

The fishing-craft activity estimating apparatus of the first to fourth aspects of the present disclosure may further include:

a smoother to apply smoothing to the activity identification result data output from the activity estimator, by correcting any of the identification results indicating the fishing craft during travel, if the identification result indicates a period shorter than a predetermined shortest travelling period, into an identification result indicating the fishing craft during fishing operation, and by correcting any of the identification results indicating the fishing craft during fishing operation, if the identification result indicates a period shorter than a predetermined shortest fishing period, into an identification result indicating the fishing craft during travel.

The fishing-craft activity estimating apparatus of the first to fourth aspects of the present disclosure may further include:

a fish catch data acquirer to acquire fish catch data indicating an amount of fish catch achieved through fishing operations of the fishing craft from departure until arrival; and a fishing efficiency index calculator to calculate, based on the amount of fish catch indicated by the fish catch data and a net length of fishing periods, a fishing efficiency index indicating an efficiency of fishing, the net length of the fishing periods being equal to a sum of periods of the identification results indicating the fishing craft during fishing operation, the identification results being indicated by the activity identification result data.

A fishing-craft activity estimating program according to a fifth aspect of the present disclosure is configured to cause a computer to function as:

a velocity feature-vector data acquirer to acquire velocity feature vector data containing velocity data and velocity dispersion data, the velocity data indicating a chronological series of velocities of a fishing craft that performs a fishing operation in a fishery and a travel to a destination, the velocity dispersion data indicating a chronological series of dispersions of the velocities of the fishing craft;

an angular-speed feature-vector data acquirer to acquire angular-speed feature vector data containing angular speed data and angular speed dispersion data, the angular speed data indicating a chronological series of angular speeds of rocking motions of the fishing craft during a navigation, the angular speed dispersion data indicating a chronological series of dispersions of the angular speeds; and an activity estimator to execute, based on the velocity feature vector data and the angular-speed feature vector data, an activity identifying process for identifying whether the fishing craft is during travel or fishing operation, and to output activity identification result data indicating a chronological series of identification results in the activity identifying process.

Advantageous Effects of Invention

The present disclosure can acquire activity identification result data indicating a chronological series of results of identification of whether the fishing craft is during travel or fishing operation.

DESCRIPTION OF EMBODIMENTS

Figure 1:
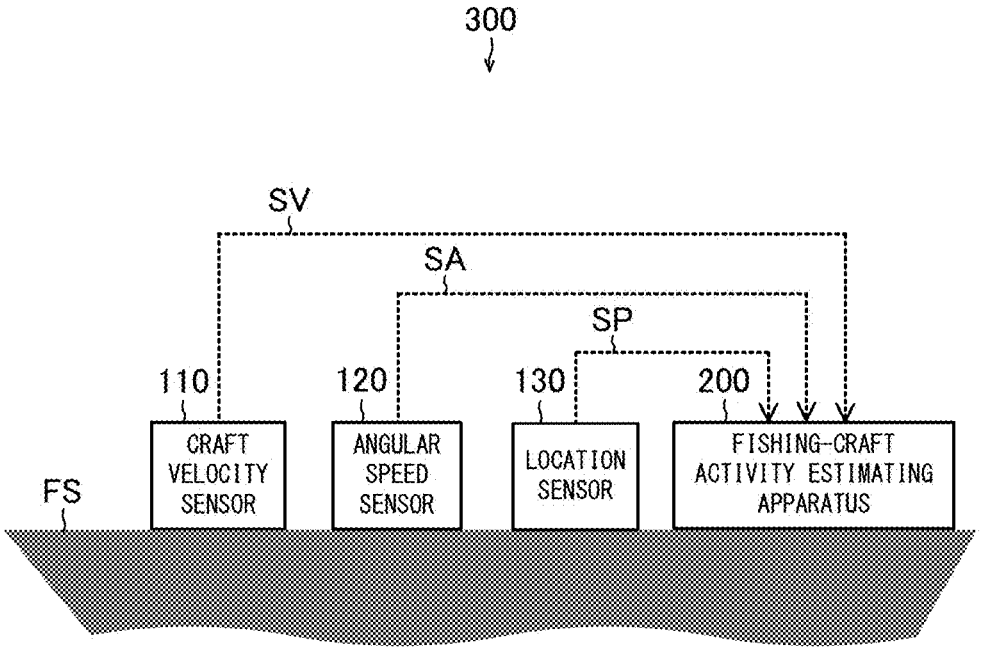
FIG. 1 is a conceptual diagram illustrating a configuration of a fishing-craft activity estimating system according to Embodiment 1.

The following describes a fishing-craft activity estimating system according to some embodiments, with reference to the accompanying drawings. In the drawings, the components identical or corresponding to each other are provided with the same reference symbol.

Embodiment 1

As illustrated in FIG. 1, a fishing-craft activity estimating system 300 according to an embodiment is installed in a fishing craft FS. The fishing craft FS performs some patterns of activities, which are described below. The fishing craft FS performs fishing operations in fisheries and travels to destinations during a navigation. Examples of the "destinations" include fisheries, ports, and anchorage sites.

Specifically, the fishing craft FS repeats fishing operations in fisheries and travels to subsequent fisheries from the departure until the arrival. In some cases, the fishing craft FS performs travels and fishing operations, is temporarily anchored before returning to the port, and performs travels and fishing operations again.

The fishing-craft activity estimating system 300 repeats estimation of an activity of the fishing craft FS, specifically, estimation of whether the fishing craft FS is during travel or fishing operation, every unit time. The results of this estimation are used to determine the net length of fishing periods, which is the net length of the periods required for the fishing operations, and to calculate the efficiency of fishing.

The following specifically describes a configuration of the fishing-craft activity estimating system 300.

The fishing-craft activity estimating system 300 includes a craft velocity sensor 110 that detects a velocity of the fishing craft FS, an angular speed sensor 120 that detects an angular speed of a rocking motion of the fishing craft FS, a location sensor 130 that detects the location of the fishing craft FS, and a fishing-craft activity estimating apparatus 200 that estimates an activity of the fishing craft FS on the basis of the results of detection by the craft velocity sensor 110, the angular speed sensor 120, and the location sensor 130.

The craft velocity sensor 110 repetitively detects velocities of the fishing craft FS, and provides the fishing-craft activity estimating apparatus 200 with detected velocity data SV indicating a chronological series of the detected velocities of the fishing craft FS.

The angular speed sensor 120 repetitively detects rocking motions of the bow of the fishing craft FS about the virtual vertical axis, that is, angular speeds in the yaw direction, and provides the fishing-craft activity estimating apparatus 200 with detected angular speed data SA indicating a chronological series of the detected angular speeds.

The location sensor 130 detects the locations of the fishing craft FS during the navigation, and provides the fishing-craft activity estimating apparatus 200 with location data SP indicating a chronological series of the detected locations. Specifically, each of the "detected locations" means the coordinate values of the location.

The craft velocity sensor 110 and the location sensor 130 each includes a global navigation satellite system (GNSS) receiver that detects parameters, such as velocities or locations, in accordance with signals from GNSS satellites, for example. The angular speed sensor 120 includes a gyroscope.

The following specifically describes a configuration of the fishing-craft activity estimating apparatus 200.

Figure 2:
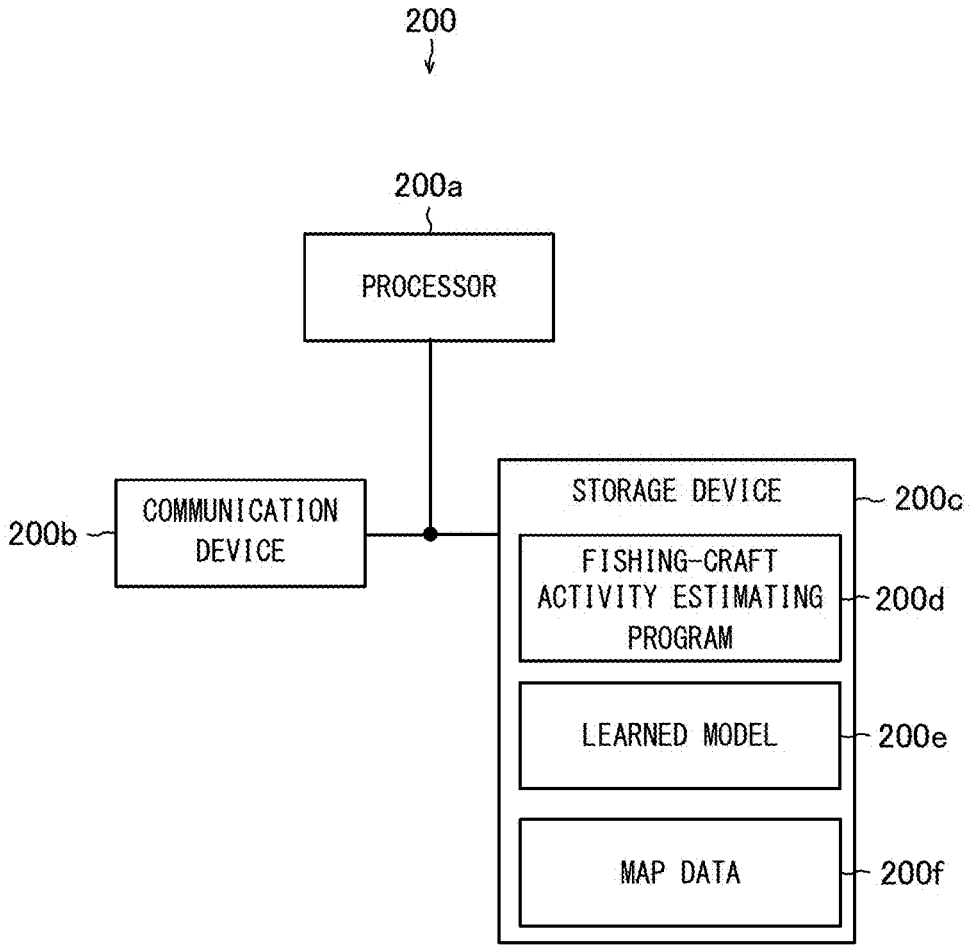
FIG. 2 is a conceptual diagram illustrating a configuration of a fishing-craft activity estimating apparatus according to Embodiment 1.

As illustrated in FIG. 2, the fishing-craft activity estimating apparatus 200 includes a communication device 200*b*. The communication device 200*b* has a function of receiving the detected velocity data SV from the craft velocity sensor 110, a function of receiving the detected angular speed data SA from the angular speed sensor 120, and a function of receiving the location data SP from the location sensor 130.

The fishing-craft activity estimating apparatus 200 also includes a storage device 200*c*. The storage device 200*c* stores a fishing-craft activity estimating program 200*d* that defines steps for estimating an activity of the fishing craft FS. The storage device 200*c* also stores a learned model 200*e* applied to estimation of an activity of the fishing craft FS, and map data 200*f* indicating the ocean and land.

The fishing-craft activity estimating apparatus 200 further includes a processor 200*a* that executes the fishing-craft activity estimating program 200*d*. The execution of the fishing-craft activity estimating program 200*d* by the processor 200*a* achieves some functions, which are described below.

Figure 3:
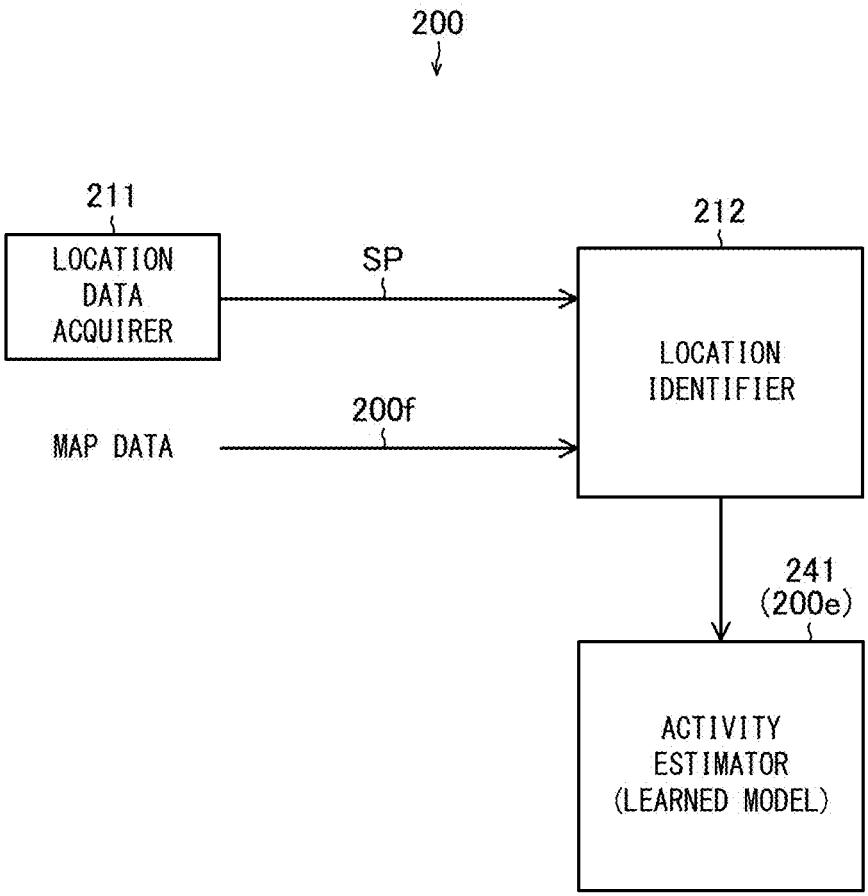
FIG. 3 is a conceptual diagram illustrating a part of the functions of the fishing-craft activity estimating apparatus according to Embodiment 1.

As illustrated in FIG. 3, the fishing-craft activity estimating apparatus 200 includes an activity estimator 241 that estimates an activity of the fishing craft FS, specifically, estimates whether the fishing craft FS is during travel or fishing operation.

The estimation of an activity of the fishing craft FS is not required while the fishing craft FS is at anchor, for example. The estimation of an activity of the fishing craft FS is required only during a navigation of the fishing craft FS. The fishing-craft activity estimating apparatus 200 thus includes components for confirming that the fishing craft FS is not at anchor. These components are described below.

The fishing-craft activity estimating apparatus 200 includes a location data acquirer 211 that acquires the location data SP indicating the locations of the fishing craft FS during the navigation. The location data acquirer 211 acquires the location data SP from the location sensor 130 illustrated in FIG. 1.

The fishing-craft activity estimating apparatus 200 also includes a location identifier 212 that executes a location identifying process on the basis of the location data SP acquired by the location data acquirer 211 and the map data 200*f* indicating the map. The map data 200*f* is acquired from the storage device 200*c* illustrated in FIG. 2.

The "location identifying process" is aimed at identifying whether the fishing craft FS is located in a coastal region or an offshore region. The coastal region means a region close to the land or a region of the ocean extending along the land. The offshore region means a region of the ocean more distant from the land than the coastal region.

The fishing craft FS located in the coastal region is expected to be at anchor or to be in a state of immediately after the departure or immediately before the arrival. The fishing craft FS located in the coastal region thus does not need the estimation of an activity of the fishing craft FS.

In contrast, the fishing craft FS located in the offshore region is expected to be during a navigation. The fishing craft FS located in the offshore region is thus regarded to be during fishing operation or during travel.

The activity estimator 241 thus estimates an activity of the fishing craft FS, when the location identifier 212 identifies that the fishing craft FS is located in the offshore region in the location identifying process. In contrast, the activity estimator 241 stops the estimation of an activity of the fishing craft FS, when the location identifier 212 identifies that the fishing craft FS is located in the coastal region in the location identifying process.

The location identifying process of the location identifier 212 involves some operations, which are specifically described below with reference to FIGS. 4 and 5.

Figure 4:
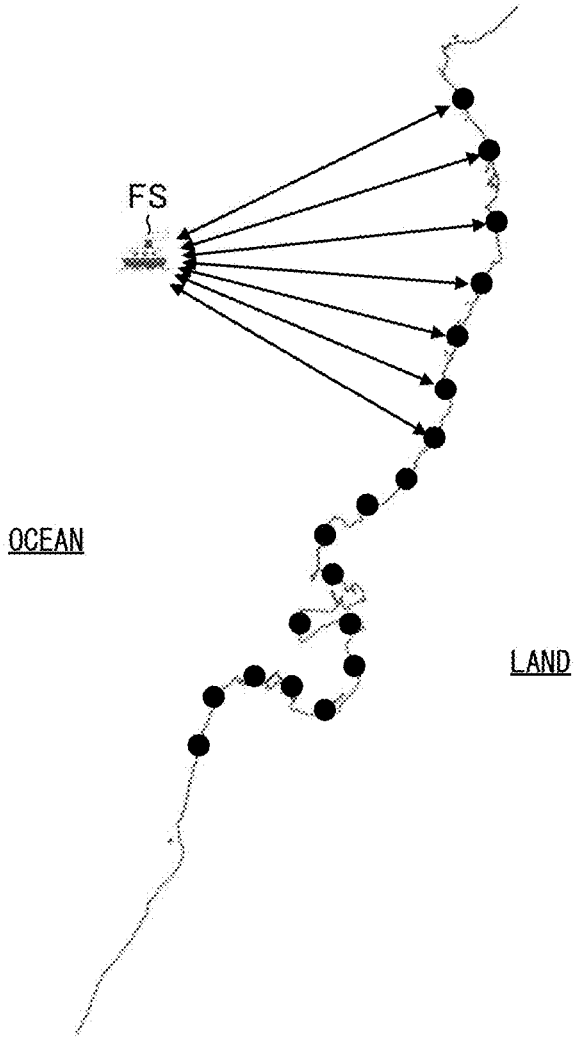
FIG. 4 is a conceptual diagram illustrating exemplary operations of a location identifying process of a location identifier according to Embodiment 1.

FIG. 4 is a conceptual diagram illustrating exemplary operations of the location identifying process of the location identifier 212. The location identifier 212 first identifies the locations of the fishing craft FS on the map on the basis of the above-mentioned location data SP. The location identifier 212 also identifies the coastline that faces the fishing craft FS on the basis of the above-mentioned map data 200*f*.

The location identifier 212 then places multiple reference points on the coastline that faces the fishing craft FS. The location identifier 212 then searches for the shortest distance among the distances from the location of the fishing craft FS to the individual reference points. The location identifier 212 thus finds out the shortest distance from the fishing craft FS to the coastline.

The location identifier 212 then compares the shortest distance from the fishing craft FS to the coastline with a threshold distance, which is preliminarily defined as the size of the coastal region. When the shortest distance from the fishing craft FS to the coastline is equal to or shorter than the threshold distance, the location identifier 212 identifies that the fishing craft FS is located in the coastal region. In contrast, when the shortest distance from the fishing craft FS to the coastline is longer than the threshold distance, the location identifier 212 identifies that the fishing craft FS is located in the offshore region.

Figure 5:
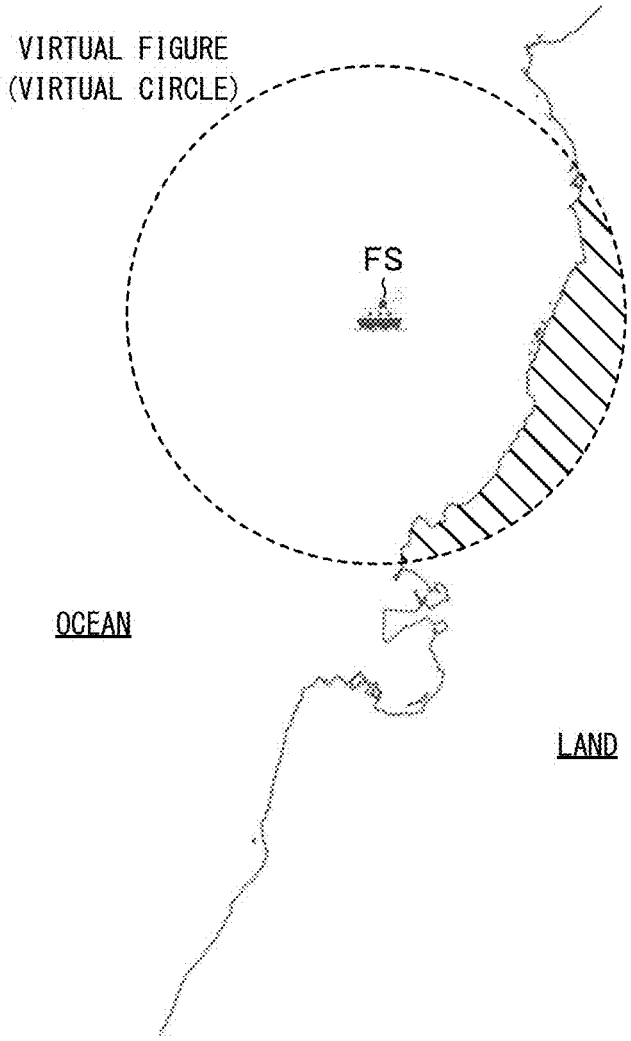
FIG. 5 is a conceptual diagram illustrating other exemplary operations of the location identifying process of the location identifier according to Embodiment 1.

FIG. 5 is a conceptual diagram illustrating other exemplary operations of the location identifying process of the location identifier 212. The location identifier 212 first identifies the location of the fishing craft FS on the map on the basis of the location data SP, and identifies the land defining the coastline that faces the fishing craft FS on the basis of the map data 200*f*.

The location identifier 212 then places, on the map, a virtual figure having the center aligned to the location of the fishing craft FS. The virtual figure has a fixed shape and a fixed area defined in advance. A typical example of the virtual figure is a virtual circle having the center aligned to the location of the fishing craft FS, as illustrated in FIG. 5. The virtual circle has a fixed radius defined in advance.

The location identifier 212 then obtains an area (hereinafter referred to as "overlapping area") of the virtual figure overlapping with the land. The overlapping area is represented by hatching in FIG. 5. The location identifier 212 then compares the overlapping area, or the ratio (hereinafter referred to as "area ratio") of the overlapping area to the area of the virtual figure, with a threshold area preliminarily defined as a value indicating the fishing craft FS located in the coastal region.

When the overlapping area or area ratio is equal to or larger than the threshold area, the location identifier 212 identifies that the fishing craft FS is located in the coastal region. In contrast, when the overlapping area or area ratio is less than the threshold area, the location identifier 212 identifies that the fishing craft FS is located in the offshore region.

Figure 6A:
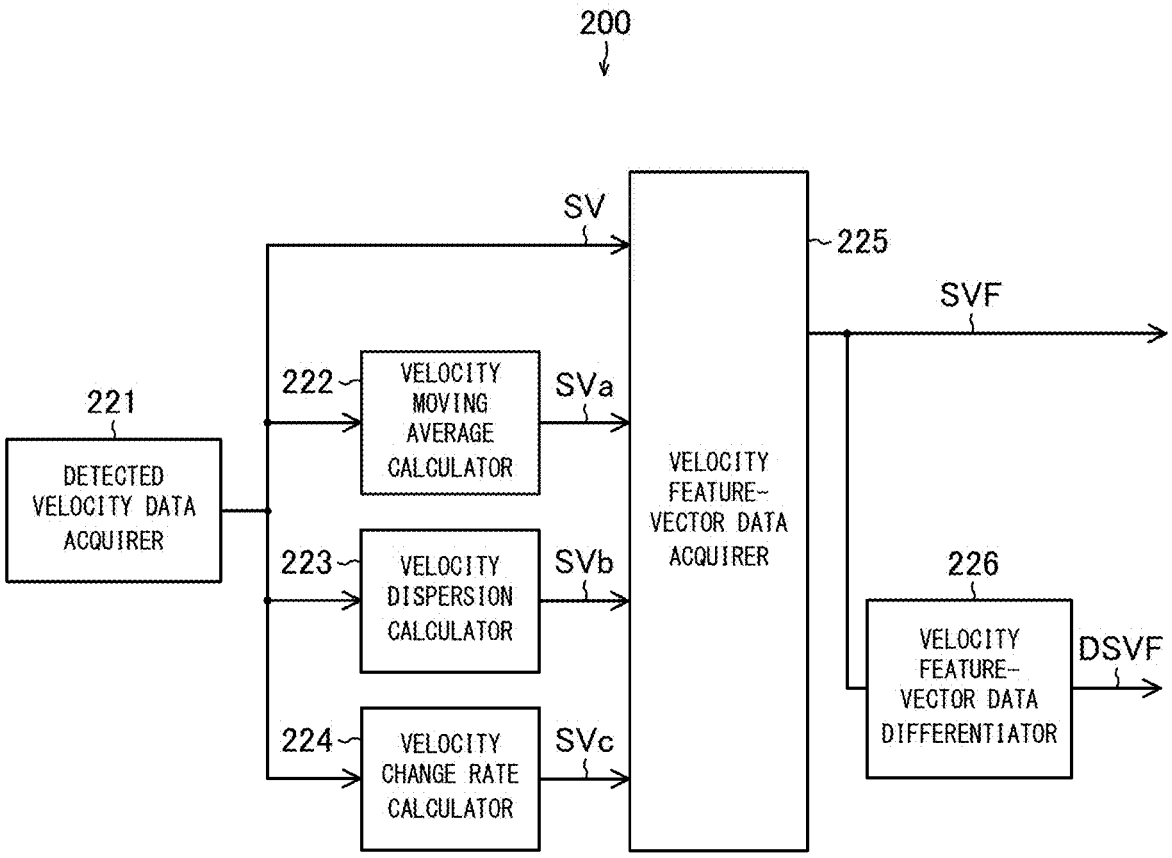
FIG. 6A is a conceptual diagram illustrating another part of the functions of the fishing-craft activity estimating apparatus according to Embodiment 1.
Figure 6B:
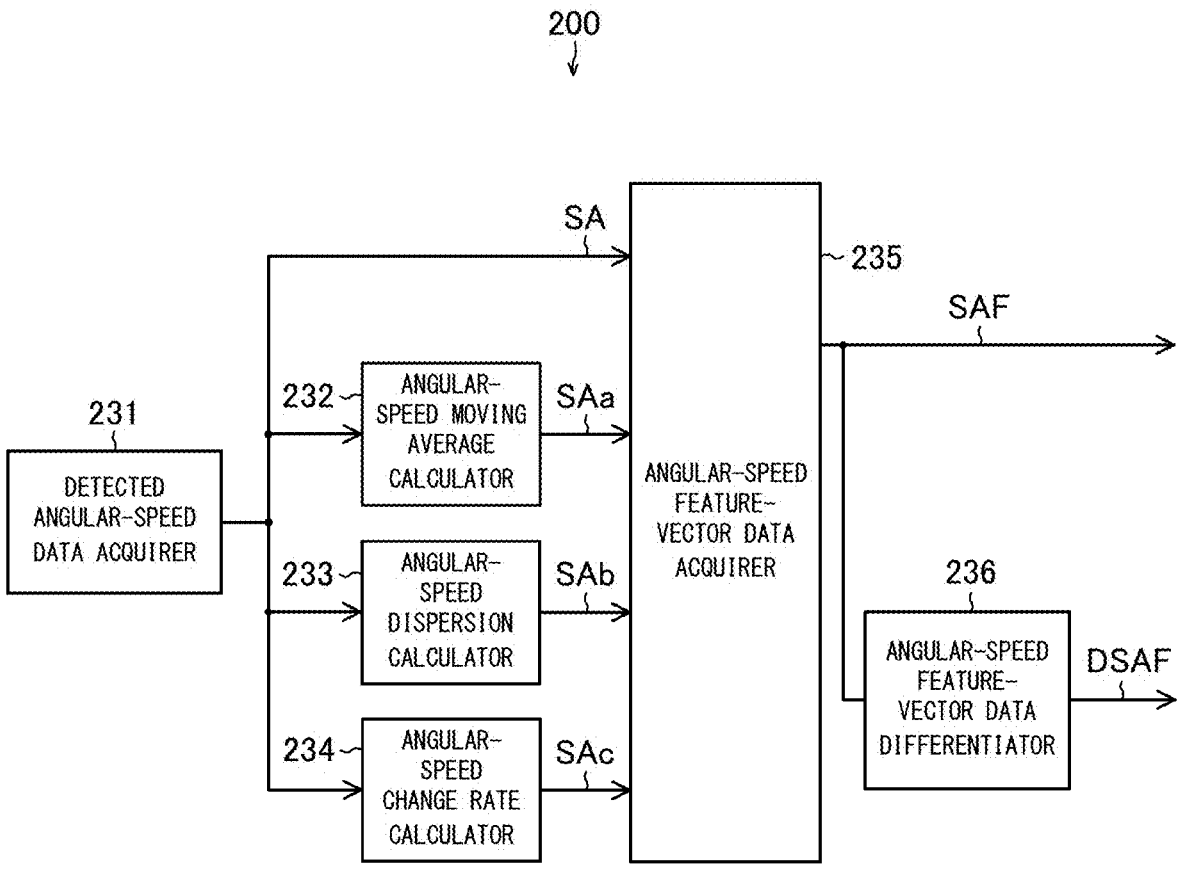
FIG. 6B is a conceptual diagram illustrating still another part of the functions of the fishing-craft activity estimating apparatus according to Embodiment 1.
Figure 6C:
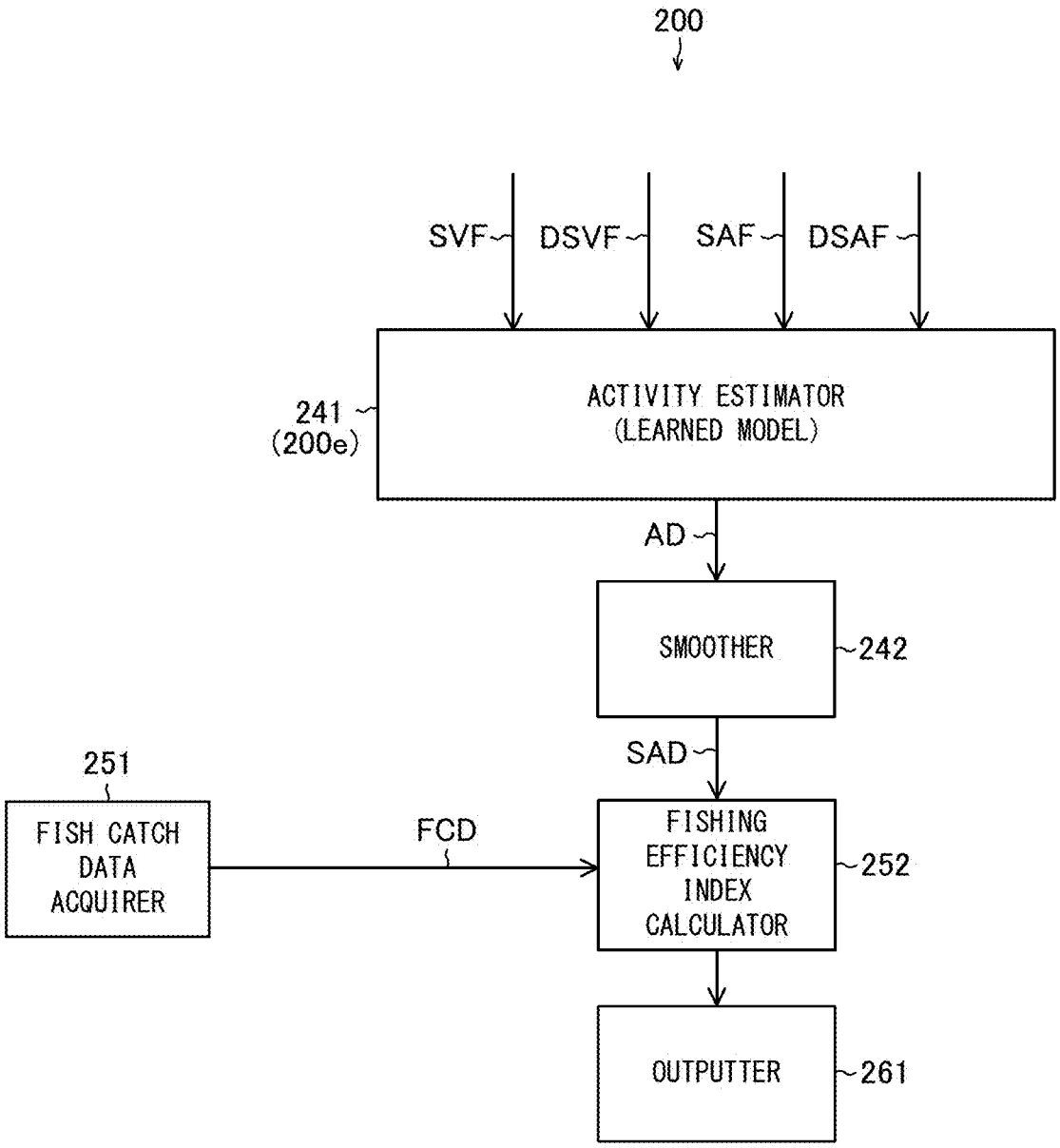
FIG. 6C is a conceptual diagram illustrating the other part of the functions of the fishing-craft activity estimating apparatus according to Embodiment 1.

The following describes other functions of the fishing-craft activity estimating apparatus 200, with reference to FIGS. 6A to 6C.

As illustrated in FIG. 6A, the fishing-craft activity estimating apparatus 200 includes a detected velocity data acquirer 221 that acquires the detected velocity data SV. The detected velocity data acquirer 221 acquires the detected velocity data SV from the craft velocity sensor 110 illustrated in FIG. 1.

The fishing-craft activity estimating apparatus 200 also includes a velocity moving average calculator 222. The velocity moving average calculator 222 generates, from the detected velocity data SV, smoothed velocity data SVa, which is the detected velocity data SV after moving average.

The interval (hereinafter referred to as "velocity moving average interval") of moving average of the velocities is at least five times and at most twenty times as long as the sampling period of the detected velocity data SV, for example. Specifically, the sampling period of the detected velocity data SV is 30 seconds, and the length of the velocity moving average interval is 300 seconds.

The fishing-craft activity estimating apparatus 200 further includes a velocity dispersion calculator 223. The velocity dispersion calculator 223 generates, from the detected velocity data SV, velocity dispersion data SVb indicating a chronological series of dispersions of the velocities of the fishing craft FS, that is, indicating how much the velocities of the fishing craft FS are dispersed.

The velocity dispersion calculator 223 calculates, for each of velocity dispersion calculation intervals preliminarily defined in the detected velocity data SV, a velocity dispersion indicating a dispersion of the velocities. The velocity dispersion calculator 223 repetitively calculates velocity dispersions, while shifting the velocity dispersion calculation interval along the temporal axis by the sampling period of the detected velocity data SV, as in the calculation of moving average. That is, the velocity dispersion data SVb indicates a chronological series of velocity dispersions.

The velocity dispersion calculation interval is at least five times and at most twenty times as long as the sampling period of the detected velocity data SV, like the interval of the moving average, for example. In this embodiment, the velocity dispersion calculation interval has a length equal to that of the velocity moving average interval.

Examples of the velocity dispersions include standard deviation, variance, fluctuation coefficient, sum of the differences from the average in all the intervals, and sum of the ratios to the average in all the intervals. The velocity dispersions are standard deviations in this embodiment.

The fishing-craft activity estimating apparatus 200 also includes a velocity change rate calculator 224. The velocity change rate calculator 224 generates, from the detected velocity data SV, velocity change rate data SVc indicating a chronological series of rates of change in the velocities of the fishing craft FS.

The velocity change rate calculator 224 calculates, for each of velocity change-rate calculation intervals preliminarily defined in the detected velocity data SV, a rate of change in the velocities. The velocity change rate calculator 224 repetitively calculates rates of change in the velocities, while shifting the velocity change-rate calculation interval along the temporal axis by the sampling period of the detected velocity data SV, as in the calculation of moving average. That is, the velocity change rate data SVc indicates a chronological series of rates of change in the velocities.

The velocity change-rate calculation interval is at least five times and at most twenty times as long as the sampling period of the detected velocity data SV, like the interval of the moving average, for example. In this embodiment, the velocity change-rate calculation interval has a length equal to that of the velocity moving average interval.

The rates of change in the velocities in this embodiment are each the inclination of a linear line segment depicted through linear approximation of fluctuations of the detected velocity data SV in the velocity change-rate calculation interval by the method of least squares. Alternatively, the rates of change in the velocities may each be the average of the differences between two detected values adjacent in the temporal axis within the velocity change-rate calculation interval, for example.

The detected velocity data SV, the smoothed velocity data SVa, the velocity dispersion data SVb, and the velocity change rate data SVc are hereinafter collectively referred to as "velocity feature vector data SVF". The total of four values of the detected velocity data SV, the smoothed velocity data SVa, the velocity dispersion data SVb, and the velocity change rate data SVc at the common time point constitute the components of the velocity feature vector data SVF at this time point. The velocity feature vector data SVF contains a chronological series of these components.

The fishing-craft activity estimating apparatus 200 further includes a velocity feature-vector data acquirer 225 that acquires the velocity feature vector data SVF from the detected velocity data acquirer 221, the velocity moving average calculator 222, the velocity dispersion calculator 223, and the velocity change rate calculator 224.

The fishing-craft activity estimating apparatus 200 also includes a velocity feature-vector data differentiator 226. The velocity feature-vector data differentiator 226 applies temporal differentiation to the velocity feature vector data SVF, and thus generates differentiated velocity feature-vector data DSVF indicating the velocity feature vector data SVF after temporal differentiation.

In this specification, chronological data after temporal differentiation means a chronological series of the differences between two values adjacent in the temporal axis in the chronological data, or a chronological series of values proportional to these differences.

The velocity feature-vector data differentiator 226 applies temporal differentiation to each of the detected velocity data SV, the smoothed velocity data SVa, the velocity dispersion data SVb, and the velocity change rate data SVc contained in the velocity feature vector data SVF.

In other words, the differentiated velocity feature-vector data DSVF contains the detected velocity data SV after temporal differentiation, the smoothed velocity data SVa after temporal differentiation, the velocity dispersion data SVb after temporal differentiation, and the velocity change rate data SVc after temporal differentiation. The chronological series of four types of differentiated values at the common time points constitute the differentiated velocity feature-vector data DSVF.

The following describes another part of the functions of the fishing-craft activity estimating apparatus 200, with reference to FIG. 6B. The fishing-craft activity estimating apparatus 200 further includes a detected angular-speed data acquirer 231 that acquires the detected angular speed data SA. The detected angular-speed data acquirer 231 acquires the detected angular speed data SA from the angular speed sensor 120 illustrated in FIG. 1.

The fishing-craft activity estimating apparatus 200 also includes an angular-speed moving average calculator 232. The angular-speed moving average calculator 232 generates, from the detected angular speed data SA, smoothed angular speed data SAa, which is the detected angular speed data SA after moving average.

The interval (hereinafter referred to as "angular-speed moving average interval") of moving average of the angular speeds is at least five times and at most twenty times as long as the sampling period of the detected angular speed data SA, for example. Specifically, the sampling period of the detected angular speed data SA is 30 seconds, and the length of the angular-speed moving average interval is 300 seconds.

The fishing-craft activity estimating apparatus 200 further includes an angular speed dispersion calculator 233. The angular speed dispersion calculator 233 generates, from the detected angular speed data SA, angular speed dispersion data SAb indicating a chronological series of dispersions of the angular speeds, that is, indicating how much the angular speeds of the bow of the fishing craft FS are dispersed.

The angular speed dispersion calculator 233 calculates, for each of angular-speed dispersion calculation intervals preliminarily defined in the detected angular speed data SA, an angular speed dispersion indicating a dispersion of the angular speeds. The angular speed dispersion calculator 233 repetitively calculates angular speed dispersions, while shifting the angular-speed dispersion calculation interval along the temporal axis by the sampling period of the detected angular speed data SA, as in the calculation of moving average. That is, the angular speed dispersion data SAb indicates a chronological series of angular speed dispersions.

The angular-speed dispersion calculation interval is at least five times and at most twenty times as long as the sampling period of the detected angular speed data SA, like the interval of the moving average, for example. In this embodiment, the angular-speed dispersion calculation interval has a length equal to that of the angular-speed moving average interval.

Examples of the angular speed dispersions include standard deviation, variance, fluctuation coefficient, sum of the differences from the average in all the intervals, and sum of the ratios to the average in all the intervals. The angular speed dispersions are standard deviations in this embodiment.

The fishing-craft activity estimating apparatus 200 also includes an angular-speed change rate calculator 234. The angular-speed change rate calculator 234, generates, from the detected angular speed data SA, angular-speed change rate data SAc indicating a chronological series of rates of change in the angular speeds.

The angular-speed change rate calculator 234 calculates, for each of angular-speed change-rate calculation intervals preliminarily defined in the detected angular speed data SA, a rate of change in the angular speeds. The angular-speed change rate calculator 234 repetitively calculates rates of change in the angular speeds, while shifting the angular-speed change-rate calculation interval along the temporal axis by the sampling period of the detected angular speed data SA, as in the calculation of moving average. That is, the angular-speed change rate data SAc indicates a chronological series of rates of change in the angular speeds.

The angular-speed change-rate calculation interval is at least five times and at most twenty times as long as the sampling period of the detected angular speed data SA, like the interval of the moving average, for example. In this embodiment, the angular-speed change-rate calculation interval has a length equal to that of the angular-speed moving average interval.

The rates of change in the angular speeds in this embodiment are each the inclination of a linear line segment depicted through linear approximation of fluctuations of the detected angular speed data SA in the angular-speed change-rate calculation interval by the method of least squares. Alternatively, the rates of change in the angular speeds may each be the average of the differences between two detected values adjacent in the temporal axis within the angular-speed change-rate calculation interval, for example.

The detected angular speed data SA, the smoothed angular speed data SAa, the angular speed dispersion data SAb, and the angular-speed change rate data SAc are hereinafter collectively referred to as "angular-speed feature vector data SAF". The total of four values of the detected angular speed data SA, the smoothed angular speed data SAa, the angular speed dispersion data SAb, and the angular-speed change rate data SAc at the common time point constitute the components of the angular-speed feature vector data SAF at this time point. The angular-speed feature vector data SAF contains a chronological series of these components.

The fishing-craft activity estimating apparatus 200 further includes an angular-speed feature-vector data acquirer 235 that acquires the angular-speed feature vector data SAF from the detected angular-speed data acquirer 231, the angular-speed moving average calculator 232, the angular speed dispersion calculator 233, and the angular-speed change rate calculator 234.

The fishing-craft activity estimating apparatus 200 also includes an angular-speed feature-vector data differentiator 236. The angular-speed feature-vector data differentiator 236 applies temporal differentiation to the angular-speed feature vector data SAF, and thus generates differentiated angular-speed feature-vector data DSAF indicating the angular-speed feature vector data SAF after temporal differentiation.

The angular-speed feature-vector data differentiator 236 applies temporal differentiation to each of the detected angular speed data SA, the smoothed angular speed data SAa, the angular speed dispersion data SAb, and the angular-speed change rate data SAc contained in the angular-speed feature vector data SAF.

In other words, the differentiated angular-speed feature-vector data DSAF contains the detected angular speed data SA after temporal differentiation, the smoothed angular speed data SAa after temporal differentiation, the angular speed dispersion data SAb after temporal differentiation, and the angular-speed change rate data SAc after temporal differentiation. The chronological series of four types of differentiated values at the common time points constitute the differentiated angular-speed feature-vector data DSAF.

The following describes the other part of the functions of the fishing-craft activity estimating apparatus 200, with reference to FIG. 6C. The activity estimator 241, which is also illustrated in FIG. 3, executes an activity identifying process for identifying whether the fishing craft FS is during travel or fishing operation, on the basis of the velocity feature vector data SVF acquired by the velocity feature-vector data acquirer 225 illustrated in FIG. 6A, the differentiated velocity feature-vector data DSVF generated by the velocity feature-vector data differentiator 226 illustrated in FIG. 6A, the angular-speed feature vector data SAF acquired by the angular-speed feature-vector data acquirer 235 illustrated in FIG. 6B, and the differentiated angular-speed feature-vector data DSAF generated by the angular-speed feature-vector data differentiator 236 illustrated in FIG. 6B.

The activity estimator 241 repetitively executes the activity identifying processes at the same interval as the sampling period of the velocity feature vector data SVF, the differentiated velocity feature-vector data DSVF, the angular-speed feature vector data SAF, and the differentiated angular-speed feature-vector data DSAF.

In this embodiment, the sampling period of the velocity feature vector data SVF, the differentiated velocity feature-vector data DSVF, the angular-speed feature vector data SAF, and the differentiated angular-speed feature-vector data DSAF is equal to the sampling period of the detected velocity data SV and the detected angular speed data SA.

The activity estimator 241 outputs results of identification in the activity identifying processes, that is, activity identification result data AD indicating a chronological series of conditions whether the fishing craft FS is during travel or fishing operation.

Figure 8:
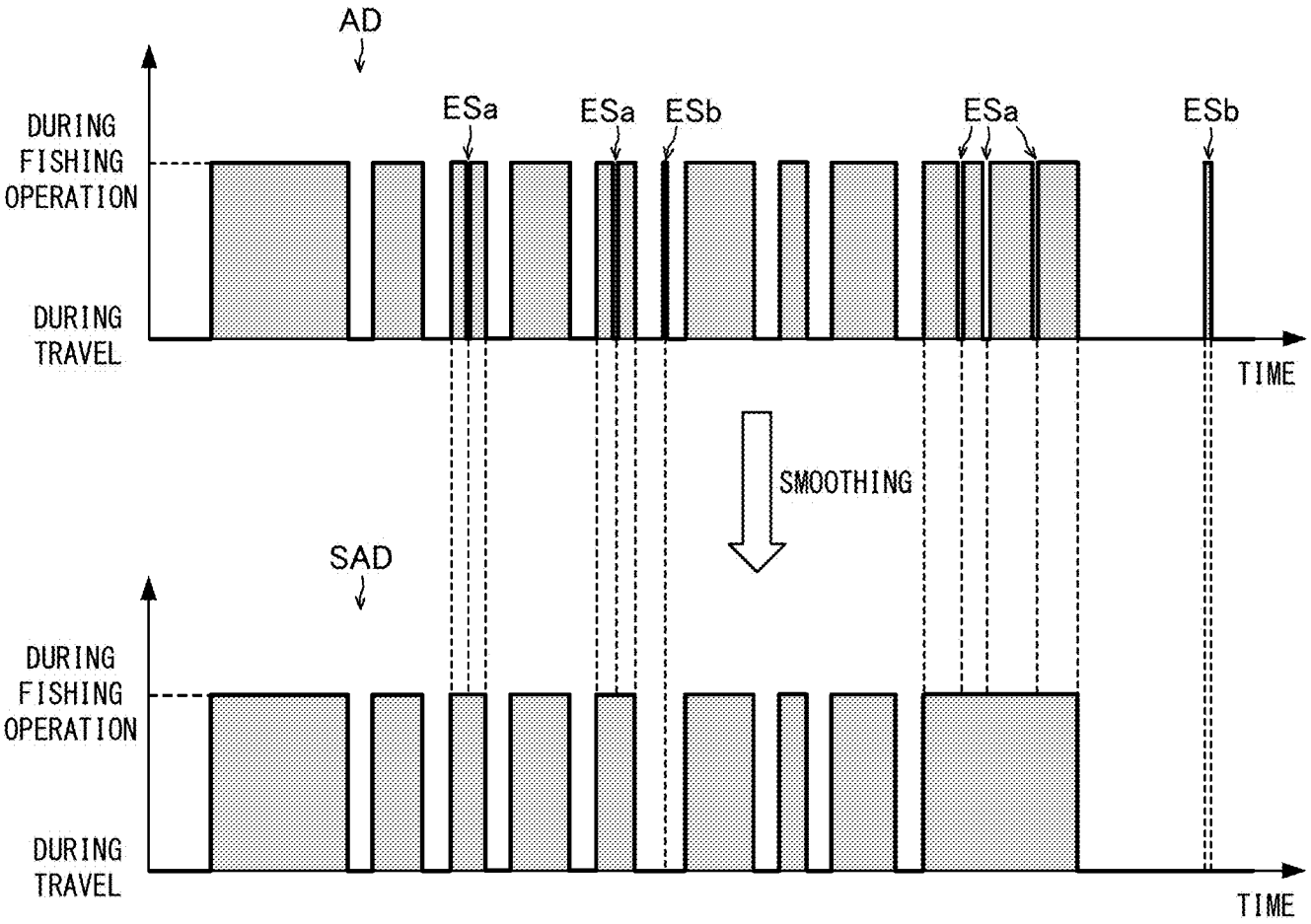
FIG. 8 is a graph illustrating activity identification result data and smoothed activity identification-result data according to Embodiment 1.

The upper section of FIG. 8 is a graph that visualizes the activity identification result data AD. The x axis represents the time. The y axis represents the results of identification in the activity identifying processes, in terms of two values consisting of a value of 0 indicating the fishing craft during travel and a value of 1 indicating the fishing craft during fishing operation, for example. The activity estimator 241 outputs the activity identification result data AD in the form of a binary step function, as illustrated in FIG. 8.

The above-described functions of the activity estimator 241 can be achieved by program modules based on artificial intelligence, specifically, the learned model 200*e* illustrated in FIG. 2. The learned model 200*e* can be applied because each of the velocity feature vector data SVF, the differentiated velocity feature-vector data DSVF, the angular-speed feature vector data SAF, and the differentiated angular-speed feature-vector data DSAF is correlated with activities of the fishing craft FS.

For example, a change in the activities of the fishing craft FS from a travel to a fishing operation tends to cause decreases in the velocities, the moving average of the velocities, and the rates of change in the velocities. For another example, the engine for thrusting the fishing craft FS during fishing operation provides a lower output than that during travel, or may be stopped in some cases. Accordingly, the dispersions of the velocities and the dispersions of the angular speeds during fishing operation tend to be larger than those during travel.

For these reasons, each of the velocity feature vector data SVF, the differentiated velocity feature-vector data DSVF, the angular-speed feature vector data SAF, and the differentiated angular-speed feature-vector data DSAF is correlated with activities of the fishing craft FS. These correlations can be used by machine learning to generate the learned model 200*e* serving as the activity estimator 241.

Specifically, the learned model 200*e* is generated by machine learning for identifying whether the fishing craft FS is during travel or fishing operation, on the basis of the velocity feature vector data SVF, the differentiated velocity feature-vector data DSVF, the angular-speed feature vector data SAF, and the differentiated angular-speed feature-vector data DSAF.

The following describes a learned model generating device for generating the learned model 200*e*.

Figure 7:
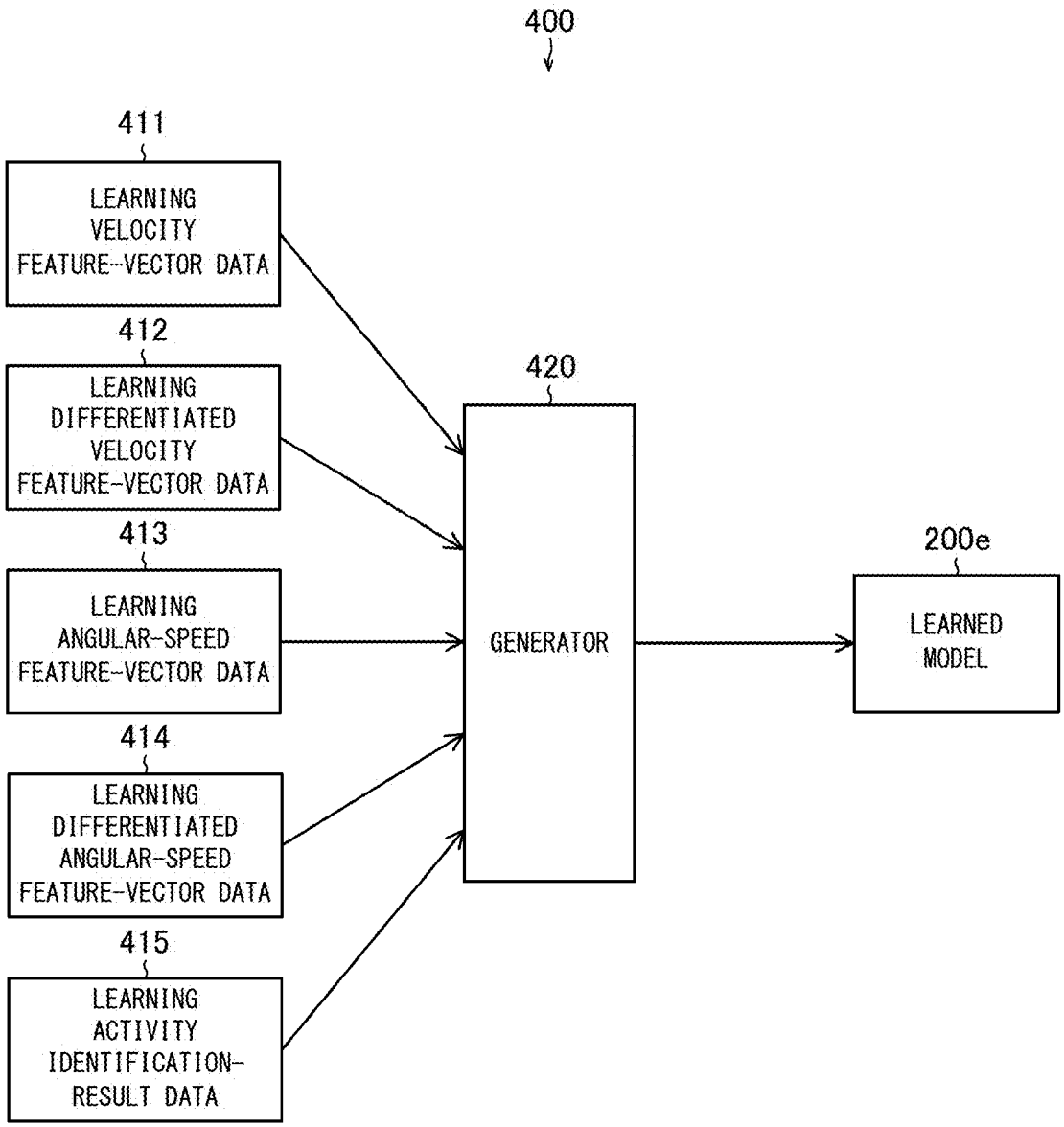
FIG. 7 is a conceptual diagram illustrating a configuration of a learned model generating device according to Embodiment 1.

As illustrated in FIG. 7, a learned model generating device 400 is provided with learning velocity feature-vector data 411, learning differentiated velocity feature-vector data 412, learning angular-speed feature-vector data 413, learning differentiated angular-speed feature-vector data 414, and learning activity identification-result data 415, which are prepared in advance.

The learning velocity feature-vector data 411 is supervision data corresponding to the velocity feature vector data SVF illustrated in FIG. 6C, and may be samples of the velocity feature vector data SVF. The learning differentiated velocity feature-vector data 412 is supervision data corresponding to the differentiated velocity feature-vector data DSVF illustrated in FIG. 6C, and may be samples of the differentiated velocity feature-vector data DSVF. The learning angular-speed feature-vector data 413 is supervision data corresponding to the angular-speed feature vector data SAF illustrated in FIG. 6C, and may be samples of the angular-speed feature vector data SAF. The learning differentiated angular-speed feature-vector data 414 is supervision data corresponding to the differentiated angular-speed feature-vector data DSAF illustrated in FIG. 6C, and may be samples of the differentiated angular-speed feature-vector data DSAF.

The learning activity identification-result data 415 is supervision data corresponding to the activity identification result data AD illustrated in FIG. 6C. The learning activity identification-result data 415 indicates details of the actual activity of the fishing craft FS accurately specified at each time point, in the case of provision of the learning velocity feature-vector data 411, the learning differentiated velocity feature-vector data 412, the learning angular-speed feature-vector data 413, and the learning differentiated angular-speed feature-vector data 414. The learning activity identification-result data 415 is manually generated, specifically, by a crew on the fishing craft FS, for example.

The learned model generating device 400 also includes a generator 420 that generates the learned model 200*e*, on the basis of the learning velocity feature-vector data 411, the learning differentiated velocity feature-vector data 412, the learning angular-speed feature-vector data 413, the learning differentiated angular-speed feature-vector data 414, and the learning activity identification-result data 415.

The generator 420 learns a policy for estimating the learning activity identification-result data 415 from the learning velocity feature-vector data 411, the learning differentiated velocity feature-vector data 412, the learning angular-speed feature-vector data 413, and the learning differentiated angular-speed feature-vector data 414. This machine learning can yield the learned model 200*e*.

The description refers back to FIG. 6C. The activity estimator 241 is achieved by the learned model 200*e*, as described above. The fishing-craft activity estimating apparatus 200 also includes a smoother 242 that applies smoothing to the activity identification result data AD output from the learned model 200*e* serving as the activity estimator 241.

The smoother 242 outputs smoothed activity identification-result data SAD, which is the activity identification result data AD after smoothing.

The lower section of FIG. 8 is a graph that visualizes the smoothed activity identification-result data SAD. The smoother 242, in the smoothing process, corrects an identification result (hereinafter referred to as "first erroneous result") ESa indicating that the fishing craft FS is during travel in the activity identification result data AD, into an identification result indicating that the fishing craft FS is during fishing operation, if the identification result ESa indicates a period shorter than a predetermined shortest travelling period.

The "period of the identification result indicating that the fishing craft FS is during travel" means the width in the temporal-axis direction of each of the rectangles aligned on the temporal axis that represent successive identification results indicating that the fishing craft FS is during travel. The "shortest travelling period" means the shortest length of an expected period of a travel of the fishing craft FS.

The shortest travelling period in this embodiment is defined to be three minutes. Since the travel of shorter than three minutes is unreal, the first erroneous results ESa each indicating a period shorter than three minutes are deemed to be generated by misidentification. The smoother 242 thus corrects these first erroneous results ESa into identification results indicating that the fishing craft FS is during fishing operation.

Also, the smoother 242, in the smoothing process, corrects an identification result (hereinafter referred to as "second erroneous result") ESb indicating that the fishing craft FS is during fishing operation in the activity identification result data AD, into an identification result indicating that the fishing craft FS is during travel, if the identification result ESa indicates a period shorter than a predetermined shortest fishing period.

The "period of the identification result indicating that the fishing craft FS is during fishing operation" means the width in the temporal-axis direction of each of the rectangles aligned on the temporal axis that represent successive identification results indicating that the fishing craft FS is during fishing operation. The "shortest fishing period" means the shortest length of an expected period of fishing operation of the fishing craft FS.

The shortest fishing period in this embodiment is defined to be five minutes. Since the fishing operation of shorter than five minutes is unreal, the second erroneous results ESb each indicating a period shorter than five minutes are deemed to be generated by misidentification. The smoother 242 thus corrects these second erroneous results ESb into identification results indicating that the fishing craft FS is during travel.

The description refers back to FIG. 6C. The fishing-craft activity estimating apparatus 200 also includes a fish catch data acquirer 251 that acquires fish catch data FCD from an external apparatus. The fish catch data FCD indicates an amount of fish catch achieved through the fishing operations of the fishing craft FS from the departure until the arrival.

The fishing-craft activity estimating apparatus 200 further includes a fishing efficiency index calculator 252 that calculates a fishing efficiency index indicating an efficiency of fishing on the basis of the fish catch data FCD and the smoothed activity identification-result data SAD, and an outputter 261 that outputs the fishing efficiency index calculated by the fishing efficiency index calculator 252 to an external apparatus.

Specifically, the fishing efficiency index calculator 252 first calculates the net length of the fishing periods, which is the sum of the identification results indicating that the fishing craft FS is during fishing operation and contained in the smoothed activity identification-result data SAD.

The calculation of the net length of the fishing periods corresponds to the calculation of the area of the colored regions in the smoothed activity identification-result data SAD illustrated in the lower section of FIG. 8. The net length of the fishing periods is the sum of the periods of fishing operations of the fishing craft FS from the departure until the arrival.

The fishing efficiency index calculator 252 then divides the amount of fish catch indicated by the fish catch data FCD, by the net length of the fishing periods. This calculation yields a fishing efficiency index, which is an amount of fish catch per unit time in the fishing periods of the fishing craft FS.

Figure 9:
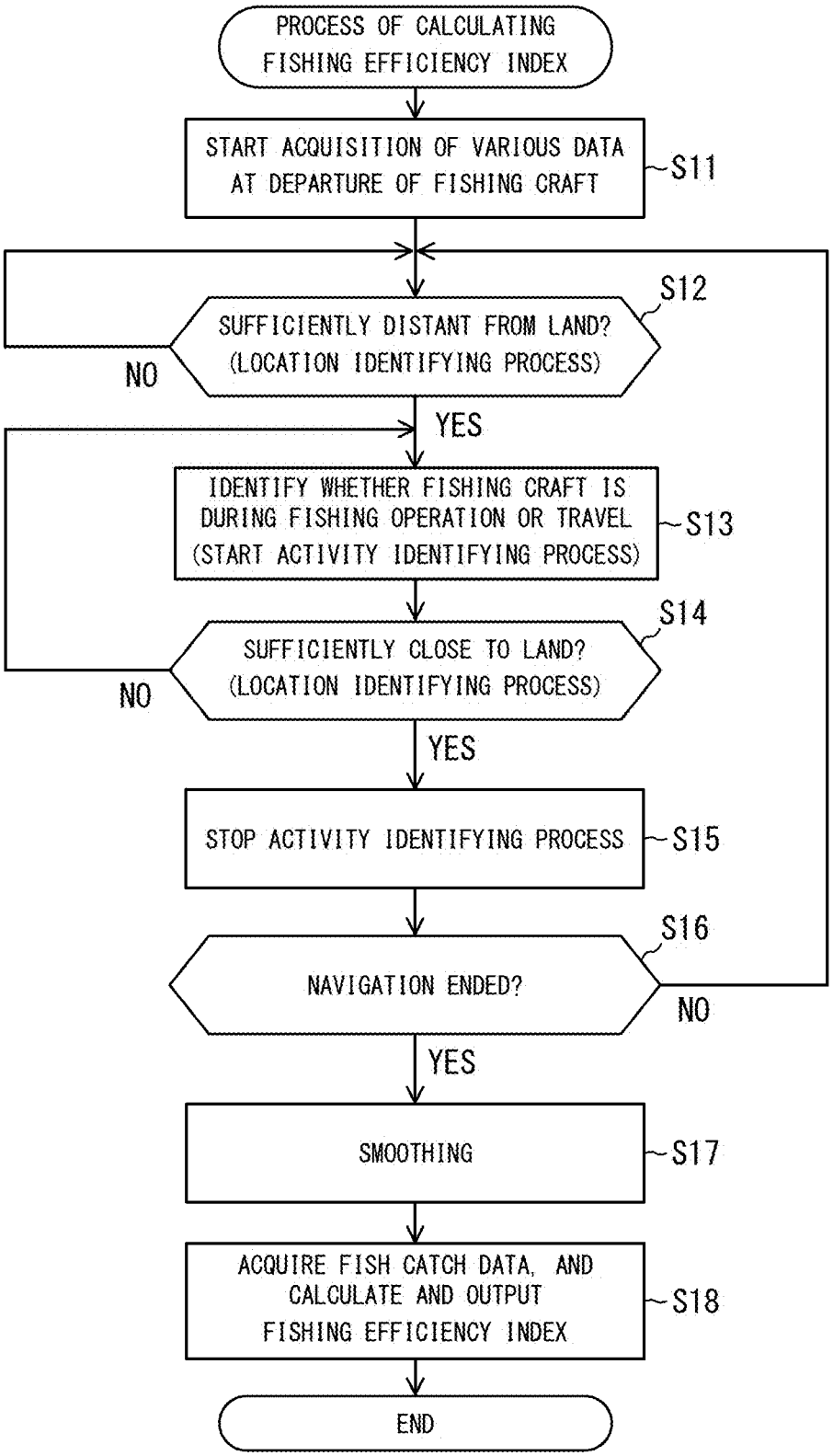
FIG. 9 is a flowchart illustrating a process of calculating a fishing efficiency index according to Embodiment 1.

The following summarizes the operations of the fishing-craft activity estimating apparatus 200 until the acquisition of the fishing efficiency index, with reference to FIG. 9. FIG. 9 is a flowchart illustrating a process of calculating a fishing efficiency index.

As illustrated in FIG. 9, the departure of the fishing craft FS is accompanied by the start of acquisition of the location data SP by the location data acquirer 211, acquisition of the detected velocity data SV by the detected velocity data acquirer 221, and acquisition of the detected angular speed data SA by the detected angular-speed data acquirer 231 (Step S11).

Each of the location data SP, the detected velocity data SV, and the detected angular speed data SA is chronological data, which contains time points and detected values at the respective time points in association with each other.

The location identifier 212 then identifies, on the basis of the location data SP, whether the fishing craft FS is sufficiently distant from the land, that is, whether the fishing craft FS is located in the offshore region distant from the land, through the location identifying process (Step S12). When the fishing craft FS is still located in the coastal region close to the land (Step S12; NO), the process returns to Step S12 because of no need to start the activity identifying process.

In contrast, when the fishing craft FS is located in the offshore region (Step S12; YES), the activity estimator 241 starts the activity identifying process (Step S13). This step leads to start of generation of the activity identification result data AD.

The location identifying process of the location identifier 212 continues in parallel to the activity identifying process of the activity estimator 241. When the activity estimator 241 identifies that the fishing craft FS is located in the offshore region distant from the land in the activity identifying process (Step S14; NO), the process returns to Step S13. The activity identifying process is thus repeated while the fishing craft FS is located in the offshore region.

The activity identifying process is repeated every sampling period of the detected velocity data SV and the detected angular speed data SA, specifically, every 30 seconds. The activity identification result data AD contains the time points of acquisition of the detected values indicated by the detected velocity data SV and the detected angular speed data SA, and the results of identification of activities of the fishing craft FS in the activity identifying processes at the respective time points, in association with each other.

In contrast, when the activity estimator 241 identifies that the fishing craft FS sufficiently approaches the land or located in the coastal region in the activity identifying process (Step S14; YES), the activity estimator 241 stops the activity identifying process (Step S15), and determines whether the navigation of the fishing craft FS is ended (Step S16).

The end of the navigation of the fishing craft FS is accompanied by the end of the acquisition of the detected velocity data SV and the detected angular speed data SA. The activity estimator 241 is thus able to detect the end of the navigation of the fishing craft FS, on the basis of the end of the acquisition of the detected velocity data SV and the detected angular speed data SA. The fishing craft FS is identified to be during the navigation while the detected velocity data SV and the detected angular speed data SA are continuously acquired.

When the navigation of the fishing craft FS is not ended (Step S16; NO), the process returns to Step S12. This step can stop the activity identifying process in an anchoring period even in the case where the fishing craft FS performs travels and fishing operations and is then temporarily anchored before returning to the port.

In contrast, when the navigation of the fishing craft FS is ended (Step S16; YES), the smoother 242 applies smoothing to the generated pieces of activity identification result data AD, as described above with reference to FIG. 8 (Step S17). This step produces smoothed activity identification-result data SAD.

Although the smoothing in Step S17 follows the acquisition of all the pieces of activity identification result data AD in this embodiment, the smoothing may be sequentially applied in Step S13 to each piece of generated activity identification result data AD.

The fish catch data acquirer 251 then acquires, from an external apparatus, the fish catch data FCD indicating an amount of fish catch achieved during the navigation from the start in Step S11 until the determination of YES in Step S16. The fishing efficiency index calculator 252 then calculates a fishing efficiency index indicating an efficiency of fishing on the basis of the fish catch data FCD and the smoothed activity identification-result data SAD, and the outputter 261 outputs the calculated fishing efficiency index to an external apparatus (Step S18).

As described above, Step S13 of the process can provide the activity identification result data AD in this embodiment. The activity identification result data AD indicates a chronological series of results of identification of whether the fishing craft FS is during travel or fishing operation.

The activity identification result data AD or the smoothed activity identification-result data SAD, which is the activity identification result data AD after smoothing, thus contributes to accurate determination of the net length of the fishing periods, which is the net length of the periods actually required by the fishing operations during the navigation of the fishing craft FS. This data accordingly contributes to accurate determination of the fishing efficiency index, which is calculated by dividing the amount of fish catch by the net length of the fishing periods.

The fishing efficiency index is contained in report data indicating fishing achievements, and recorded into a database, which is not illustrated. This record can lead to understanding of a fluctuation tendency of the fishing efficiency index. The understanding of a fluctuation tendency of the fishing efficiency index facilitates protection of fishery resources. Specifically, the protection of fishery resources can be achieved by taking measures of refraining from fishing against a tendency of decrease in the efficiency of fishing.

Embodiment 2

In Embodiment 1 described above, the activity identifying process involves identification of only whether the fishing craft FS is during fishing operation or travel. When the fishing craft FS is identified to be during fishing operation, the activity identifying process may be followed by estimation of the details of the fishing operations. The following describes a specific example thereof.

Figure 10:
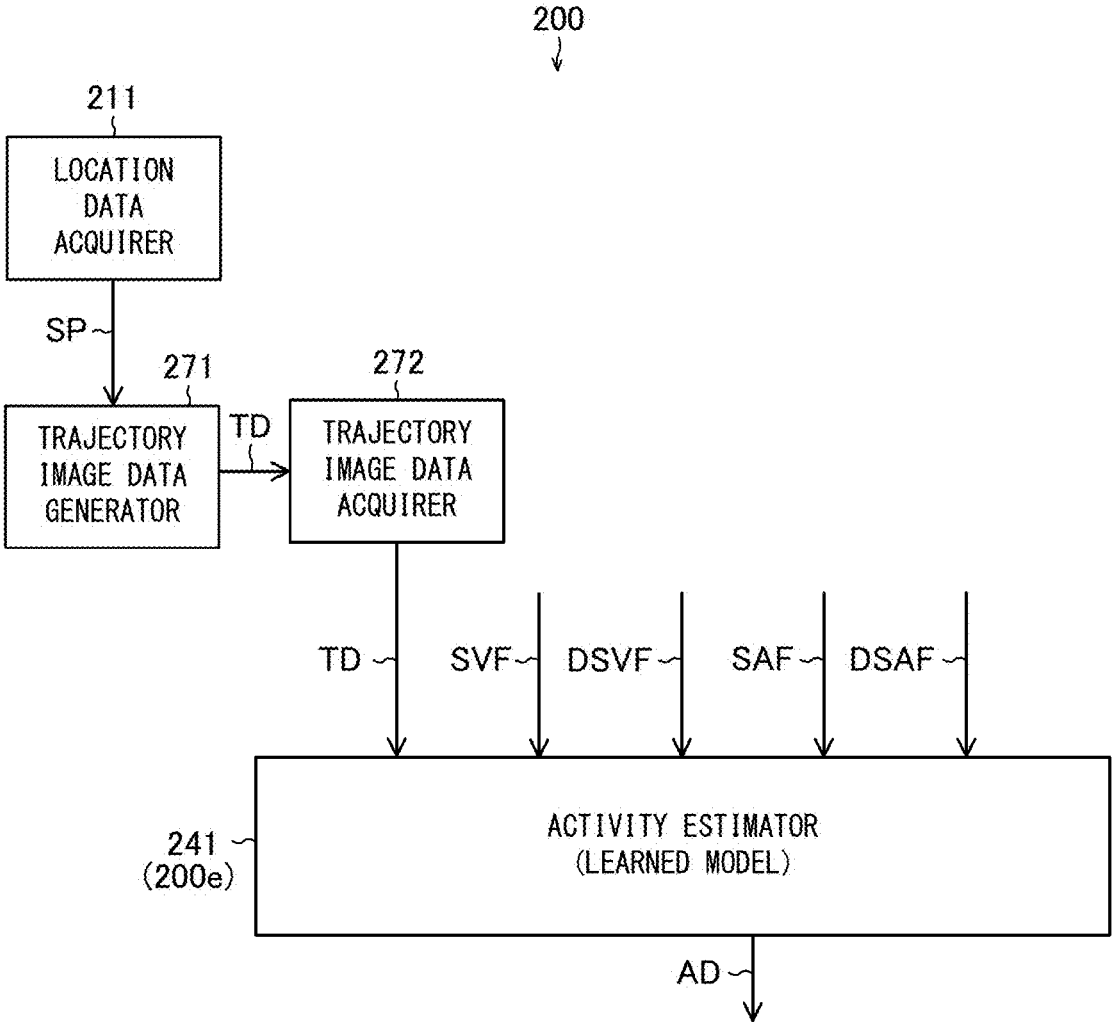
FIG. 10 is a conceptual diagram illustrating a part of the functions of a fishing-craft activity estimating apparatus according to Embodiment 2.

As illustrated in FIG. 10, the fishing-craft activity estimating apparatus 200 according to another embodiment further includes a trajectory image data generator 271 that generates trajectory image data TD indicating a trajectory of the fishing craft FS during the navigation on the basis of the location data SP indicating a chronological series of the locations of the fishing craft FS during the navigation, and a trajectory image data acquirer 272 that acquires the trajectory image data TD from the trajectory image data generator 271.

That is, the location data SP in this embodiment is applied to not only the above-described location identifying process but also the generation of the trajectory image data TD.

The activity estimator 241 receives not only input of the velocity feature vector data SVF, the differentiated velocity feature-vector data DSVF, the angular-speed feature vector data SAF, and the differentiated angular-speed feature-vector data DSAF (hereinafter collectively referred to as "fishing craft behavior data"), but also input of the trajectory image data TD acquired by the trajectory image data acquirer 272.

The activity estimator 241, when determining that the fishing craft FS is during fishing operation in the activity identifying process, further executes a fishing detail estimating process for estimating the details of the fishing operations on the basis of the trajectory image data TD and the fishing craft behavior data.

The "details of the fishing operations" in this embodiment contain the types of caught aquatic products. That is, the activity estimator 241 is able to estimate the types of caught aquatic products as the details of the fishing operations of the fishing craft FS.

The trajectory image data TD and the fishing craft behavior data are correlated with the details of the fishing operations of the fishing craft FS. The details of the fishing operations of the fishing craft FS can thus be estimated, in principle, on the basis of the trajectory image data TD and the fishing craft behavior data.

The following describes exemplary correlations of the trajectory image data TD and the fishing craft behavior data, with the details of the fishing operations of the fishing craft FS.

Figure 11:
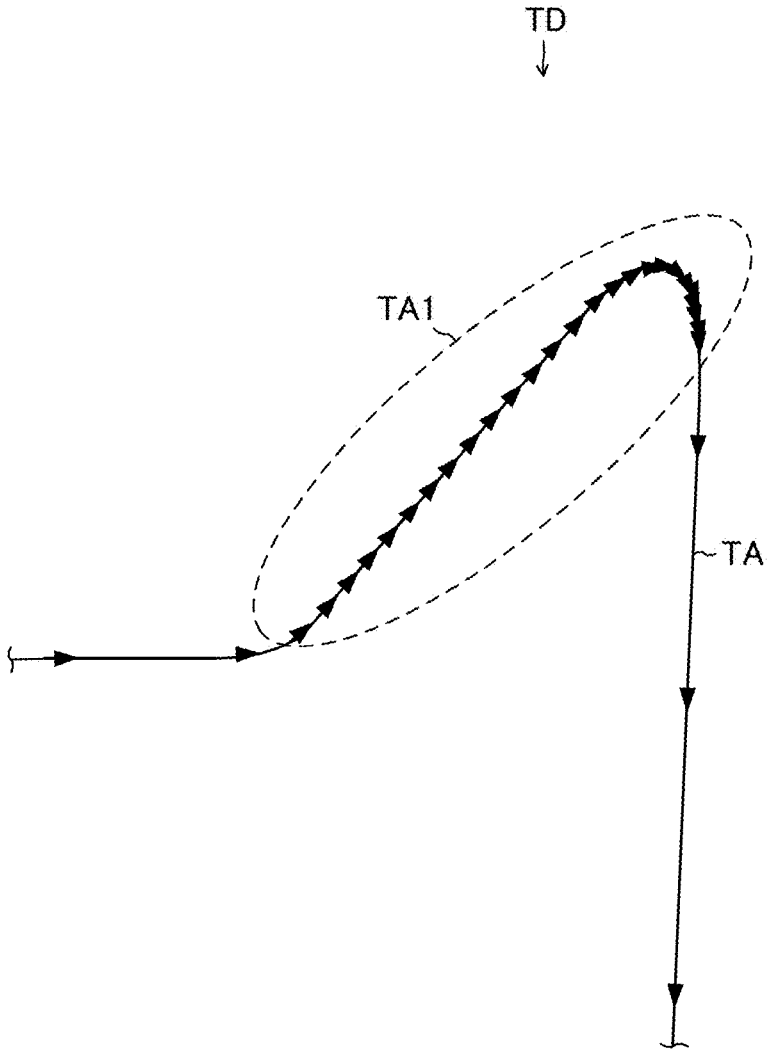
FIG. 11 is a conceptual diagram illustrating an example of trajectory image data according to Embodiment 2.

FIG. 11 illustrates an example of the trajectory image data TD. The trajectory image data TD indicates a trajectory TA of the fishing craft FS. The trajectory TA is defined by plotting the coordinate values indicating the locations of the fishing craft FS on a two-dimensional coordinate plane, and connecting the adjacent plots to each other with line segments.

The trajectory TA in FIG. 11 is provided with arrows representing traveling directions of the craft FS with the same time interval, in order to clarify the velocities. A shorter interval between arrows means a lower velocity. The arrows may be excluded from the actual trajectory image data TD because the parameters, such as the velocities, can be identified from the fishing craft behavior data.

The trajectory TA contains some segments TAT (hereinafter referred to as "extremely slow segments") in which the craft FS travels extremely slowly while being drifted. Such extremely slow segments TAT are characteristic in drift squid fishing.

Accordingly, the details of the fishing operations are estimated to involve squid fishing, on the basis of the characteristic shape of the trajectory TA containing the extremely slow segments TAT indicated by the trajectory image data TD, and the parameters, such as the velocities, in the extremely slow segments TAT identified from the fishing craft behavior data.

Figure 12:
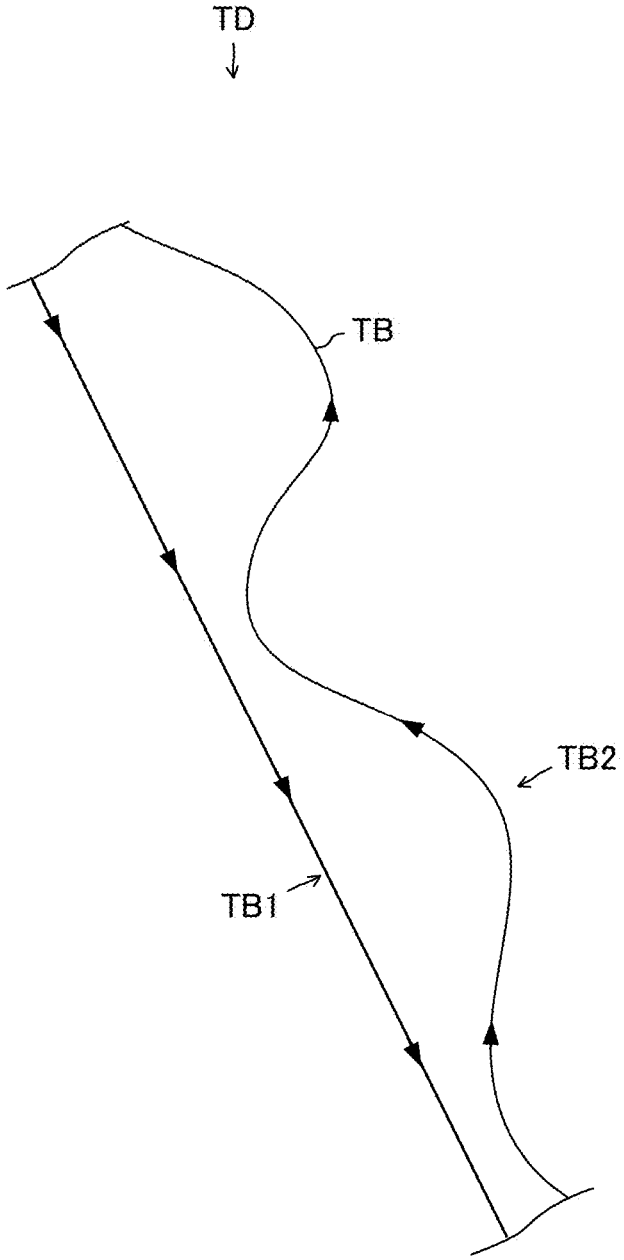
FIG. 12 is a conceptual diagram illustrating another example of the trajectory image data according to Embodiment 2.

FIG. 12 illustrates another example of the trajectory image data TD. The trajectory TB in this example contains a combination of outward segments TB1 representing a linear travel, and return segments TB2 representing a tortuous return travel along the outward segments TB1.

Such a combination of the outward segments TB1 and the return segments TB2 are characteristic in longline fishing for adult yellowtails. Specifically, the outward segments TB1 correspond to development of a longline, and the return segments TB2 correspond to collection of the longline.

Accordingly, the details of the fishing operations are estimated to involve longline fishing for adult yellowtails, on the basis of the characteristic shape of the trajectory TB containing the outward segments TB1 and the return segments TB2 indicated by the trajectory image data TD, small dispersions of the velocities and the angular speeds in the outward segments TB1 identified from the fishing craft behavior data, and periodic fluctuations of the angular speeds in the return segments TB2 identified from the fishing craft behavior data, for example.

As described above, the trajectory image data TD and the fishing craft behavior data are correlated with the details of the fishing operations of the fishing craft FS. Although FIGS. 11 and 12 illustrate the squid fishing and the longline fishing for adult yellowtails as exemplary details of the fishing operations of the fishing craft FS, persons skilled in the art will recognize that fishing operations for other aquatic products can also be identified from the trajectory image data TD and the fishing craft behavior data.

These correlations are used to achieve the functions of the activity estimator 241 illustrated in FIG. 10 by means of machine learning. That is, the learned model 200*e* according to the embodiment serving as the activity estimator 241 is generated by machine learning for identifying whether the fishing craft FS is during travel or fishing operation on the basis of the velocity feature vector data SVF, the differentiated velocity feature-vector data DSVF, the angular-speed feature vector data SAF, and the differentiated angular-speed feature-vector data DSAF, and for estimating the details of the fishing operations on the basis of the trajectory image data TD when the fishing craft FS is identified to be during fishing operation.

The following describes the learned model generating device 400 that generates the learned model 200*e* according to the embodiment.

Figure 13:
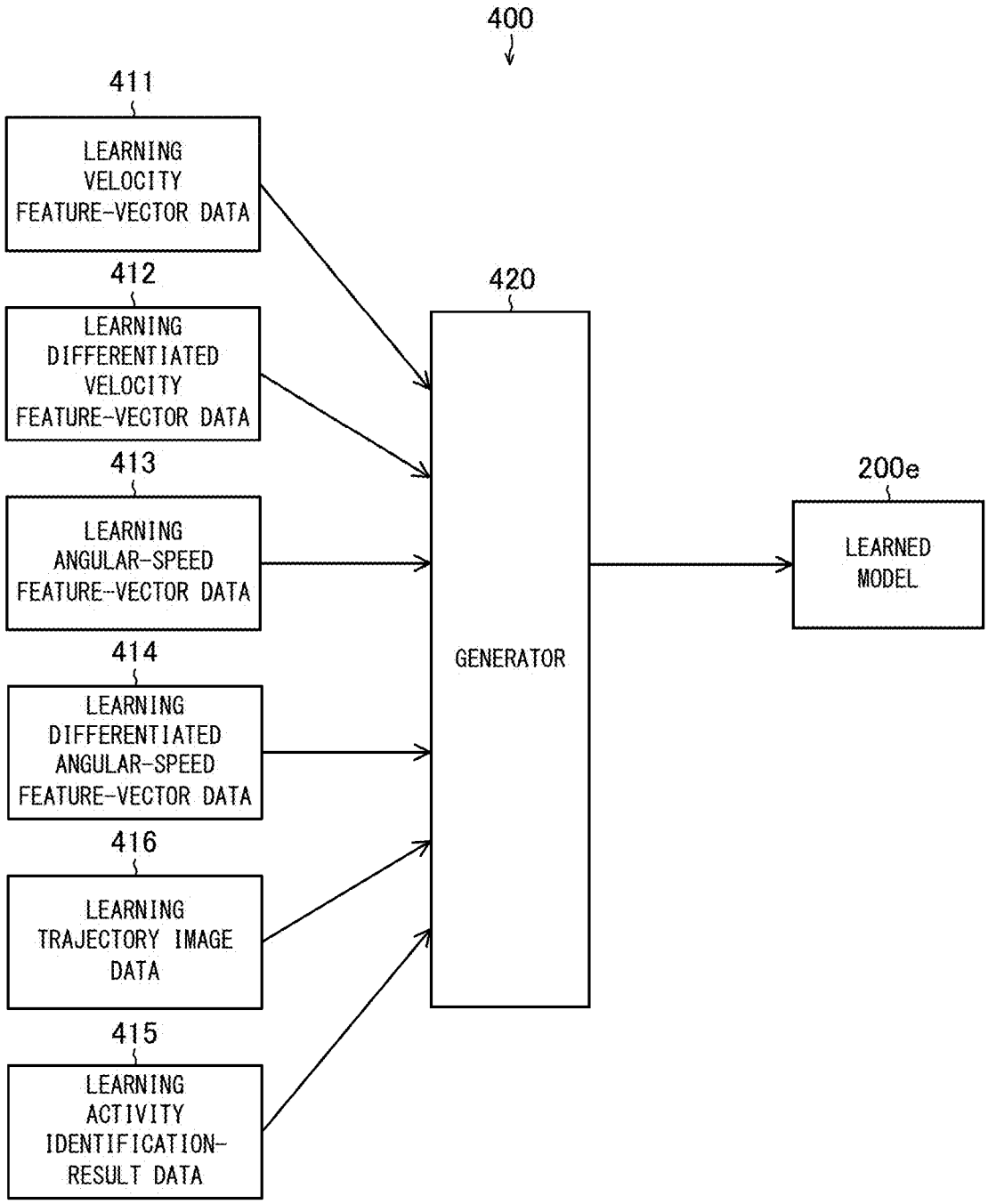
FIG. 13 is a conceptual diagram illustrating a configuration of a learned model generating device according to Embodiment 2.

As illustrated in FIG. 13, the learned model generating device 400 according to the embodiment is also provided with learning trajectory image data 416 prepared in advance. The learning trajectory image data 416 is supervision data corresponding to the trajectory image data TD illustrated in FIG. 10, and may be samples of the trajectory image data TD.

The learning trajectory image data 416 contains chronological image data indicating a trajectory of the fishing craft FS, like the trajectory image data TD. The time points of the chronological image data correspond to the respective time points indicated by the learning velocity feature-vector data 411, the learning differentiated velocity feature-vector data 412, the learning angular-speed feature-vector data 413, the learning differentiated angular-speed feature-vector data 414, and the learning activity identification-result data 415.

The learning activity identification-result data 415 is supervision data corresponding to the activity identification result data AD illustrated in FIG. 10. The learning activity identification-result data 415 indicates the details of the actual activity of the fishing craft FS accurately specified at each time point, in the case of provision of the learning velocity feature-vector data 411, the learning differentiated velocity feature-vector data 412, the learning angular-speed feature-vector data 413, the learning differentiated angular-speed feature-vector data 414, and the learning trajectory image data 416. The learning activity identification-result data 415 is manually generated, specifically, by a crew on the fishing craft FS, for example.

The generator 420 learns a policy for estimating the learning activity identification-result data 415 from the learning velocity feature-vector data 411, the learning differentiated velocity feature-vector data 412, the learning angular-speed feature-vector data 413, the learning differentiated angular-speed feature-vector data 414, and the learning trajectory image data 416. This machine learning can yield the learned model 200*e*.

Figure 14:
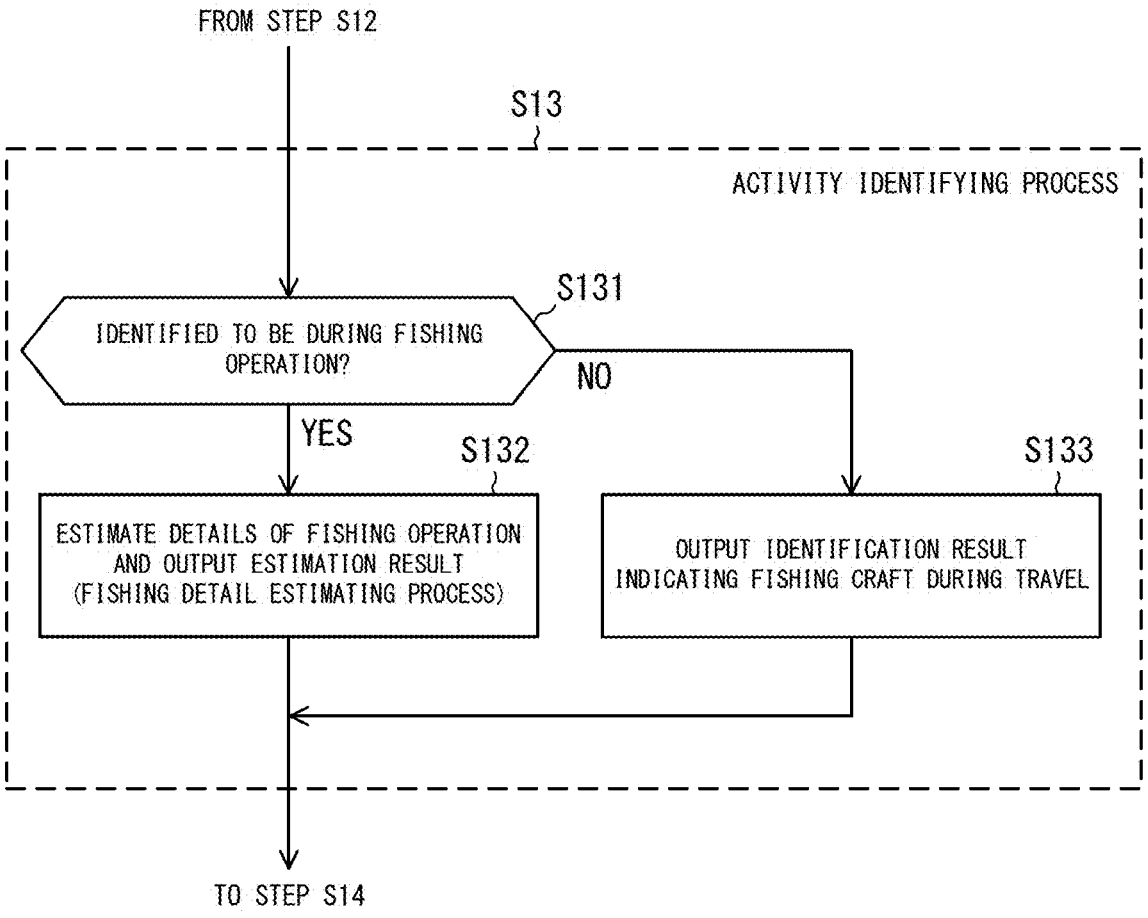
FIG. 14 is a flowchart illustrating an activity identifying process according to Embodiment 2.

The following describes the activity identifying process according to the embodiment (Step S13 in FIG. 9), with reference to FIG. 14.

As illustrated in FIG. 14, the activity estimator 241 first determines whether the fishing craft FS is during fishing operation, on the basis of the velocity feature vector data SVF, the differentiated velocity feature-vector data DSVF, the angular-speed feature vector data SAF, and the differentiated angular-speed feature-vector data DSAF (Step S131).

The activity estimator 241, when determining that the fishing craft FS is not during fishing operation but during travel (Step S131; NO), outputs an identification result indicating that the fishing craft FS is during travel as a piece of chronological data contained in the activity identification result data AD (Step S133).

In contrast, the activity estimator 241, when determining that the fishing craft FS is during fishing operation (Step S131; YES), further executes a fishing detail estimating process for estimating the details of the fishing operations, on the basis of the velocity feature vector data SVF, the differentiated velocity feature-vector data DSVF, the angular-speed feature vector data SAF, the differentiated angular-speed feature-vector data DSAF, and the trajectory image data TD. The activity estimator 241 then outputs a result of estimation in the fishing detail estimating process as a piece of chronological data contained in the activity identification result data AD (Step S132).

The activity identification result data AD and the smoothed activity identification-result data SAD can be represented as a step function having three or more values, by assigning mutually different numerical values to the respective details of the fishing operations expected as the results of estimation in the fishing detail estimating process.

For example, in the case where results of estimation in the fishing detail estimating process are expected to be squid fishing or longline fishing for adult yellowtails, a value of 1 is assigned to the squid fishing, and a value of 2 is assigned to the longline fishing for adult yellowtails. Also, a value of 0 is assigned to an identification result that the fishing craft is during travel, as described above with reference to FIG. 8. In this case, the activity identification result data AD and the smoothed activity identification-result data SAD are represented as a ternary step function.

This embodiment can acquire the net length of the fishing periods on the basis of the activity identification result data AD or the smoothed activity identification-result data SAD. The embodiment can also acquire the net length of a period required by each of the details of the fishing operations as the results of estimation in the fishing detail estimating process. The fish catch data FCD illustrated in FIG. 6C in the embodiment contains the amounts of caught aquatic products in association with the respective aquatic products.

Specifically, in the above-described example, the net length of periods required for squid fishing and the net length of periods required for longline fishing for adult yellowtails from the departure until the arrival can each be determined on the basis of the activity identification result data AD or the smoothed activity identification-result data SAD. The individual amounts of caught squids and adult yellowtails can each be identified from the fish catch data FCD.

The fishing efficiency index calculator 252 illustrated in FIG. 6C in this embodiment can determine fishing efficiency indexes indicating the efficiencies of fishing of aquatic products caught by the fishing craft FS, for the respective aquatic products. This configuration can achieve precise understanding of the types of aquatic products suffering from overfishing, leading to more appropriate protection of fishery resources.

Embodiment 3

FIGS. 6A and 6B illustrate the fishing-craft activity estimating apparatus 200 including both of the velocity feature-vector data acquirer 225 and the angular-speed feature-vector data acquirer 235. Alternatively, the fishing-craft activity estimating apparatus 200 in Embodiments 1 and 2 may include either of the velocity feature-vector data acquirer 225 and the angular-speed feature-vector data acquirer 235 alone, because each of the velocity feature vector data SVF and the angular-speed feature vector data SAF is correlated with activities of the fishing craft FS. The following describes a specific example thereof.

Figure 15:
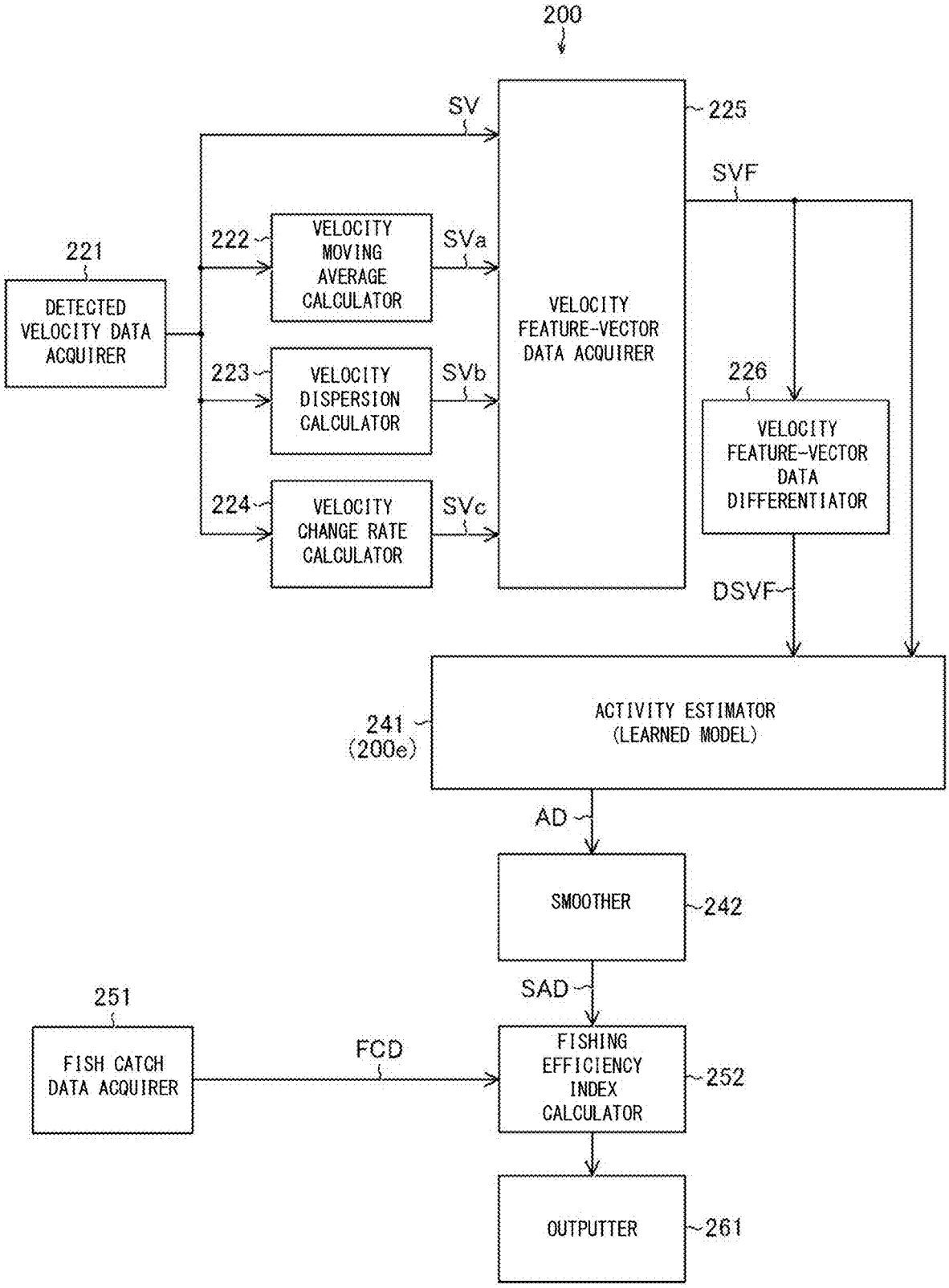
FIG. 15 is a conceptual diagram illustrating a part of the functions of a fishing-craft activity estimating apparatus according to Embodiment 3.

As illustrated in FIG. 15, the activity estimator 241 according to another embodiment executes the above-described activity identifying process on the basis of the velocity feature vector data SVF and the differentiated velocity feature-vector data DSVF, and then outputs the activity identification result data AD indicating a chronological series of conditions whether the fishing craft FS is during travel or fishing operation.

The velocity feature vector data SVF and the differentiated velocity feature-vector data DSVF are correlated with the conditions whether the fishing craft FS is during travel or fishing operation. The activity identifying process can thus be executed, in principle, without the angular-speed feature vector data SAF and the differentiated angular-speed feature-vector data DSAF illustrated in FIG. 10.

Also, the activity estimator 241 according to the embodiment executes the above-described fishing detail estimating process, on the basis of the velocity feature vector data SVF, the differentiated velocity feature-vector data DSVF, and the trajectory image data TD illustrated in FIG. 10.

The velocity feature vector data SVF and the differentiated velocity feature-vector data DSVF are correlated with the details of the fishing operations of the fishing craft FS. The fishing detail estimating process can thus be executed, in principle, without the angular-speed feature vector data SAF and the differentiated angular-speed feature-vector data DSAF illustrated in FIG. 10.

In this embodiment, a learned model serving as the activity estimator 241 is generated without the learning angular-speed feature-vector data 413 and the learning differentiated angular-speed feature-vector data 414, which are the supervision data illustrated in FIG. 13. The other configurations and operations are identical to those in Embodiments 1 and 2.

Embodiment 4

Figure 16:
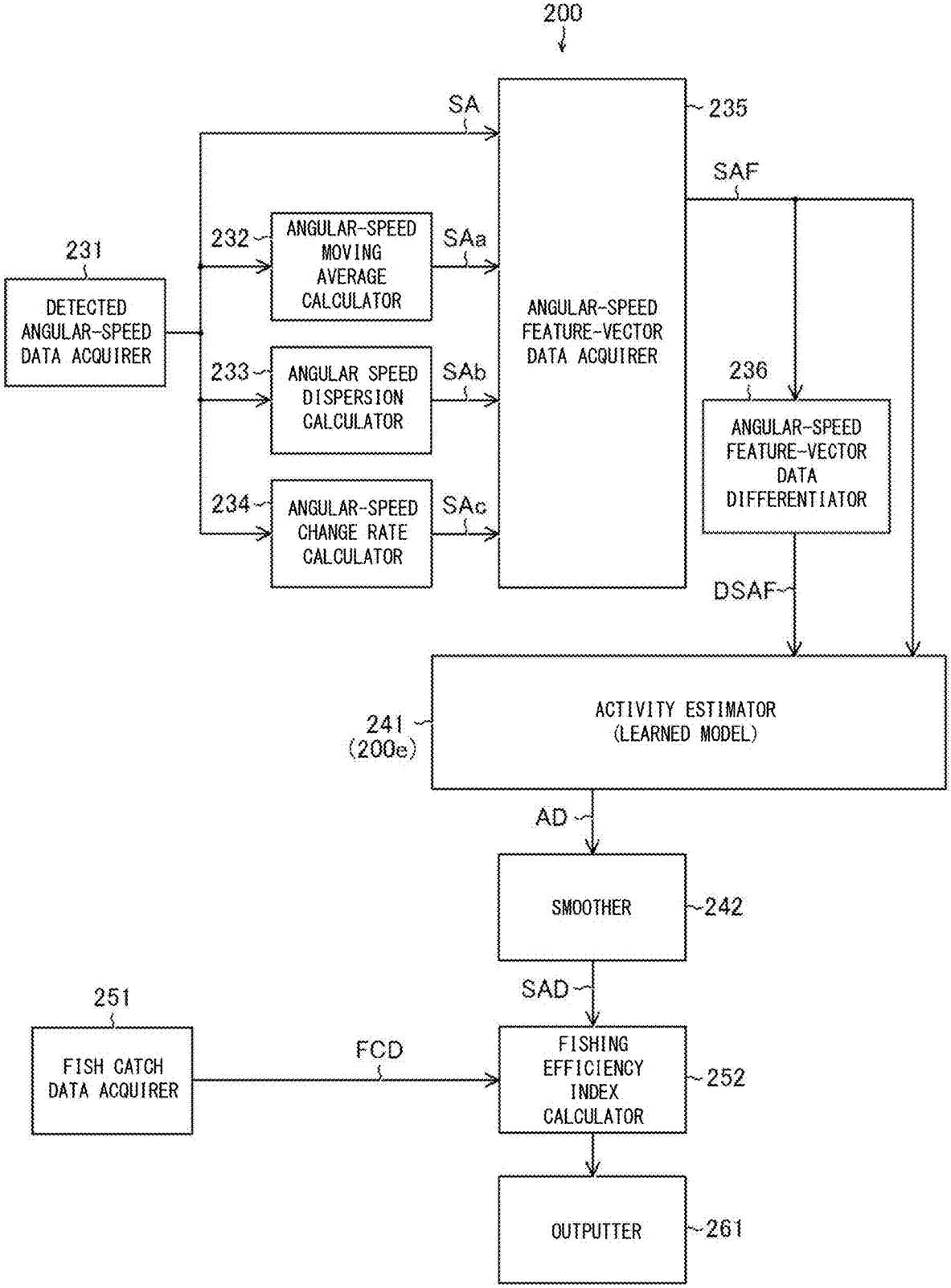
FIG. 16 is a conceptual diagram illustrating a part of the functions of a fishing-craft activity estimating apparatus according to Embodiment 4.

As illustrated in FIG. 16, the activity estimator 241 according to another embodiment executes the above-described activity identifying process on the basis of the angular-speed feature vector data SAF and the differentiated angular-speed feature-vector data DSAF, and then outputs the activity identification result data AD indicating a chronological series of conditions whether the fishing craft FS is during travel or fishing operation.

The angular-speed feature vector data SAF and the differentiated angular-speed feature-vector data DSAF are correlated with the conditions whether the fishing craft FS is during travel or fishing operation. The activity identifying process can thus be executed, in principle, without the velocity feature vector data SVF and the differentiated velocity feature-vector data DSVF illustrated in FIG. 10.

Also, the activity estimator 241 according to the embodiment executes the above-described fishing detail estimating process, on the basis of the angular-speed feature vector data SAF, the differentiated angular-speed feature-vector data DSAF, and the trajectory image data TD illustrated in FIG. 10.

The angular-speed feature vector data SAF and the differentiated angular-speed feature-vector data DSAF are correlated with the details of the fishing operations of the fishing craft FS. The fishing detail estimating process can thus be executed, in principle, without the velocity feature vector data SVF and the differentiated velocity feature-vector data DSVF illustrated in FIG. 10.

In this embodiment, a learned model serving as the activity estimator 241 is generated without the learning velocity feature-vector data 411 and the learning differentiated velocity feature-vector data 412, which are the supervision data illustrated in FIG. 13. The other configurations and operations are identical to those in Embodiments 1 and 2.

Embodiment 5

Although the activity identifying process and the fishing detail estimating process are based on the detected angular speed data SA and the detected velocity data SV in Embodiment 2, these pieces of data may be replaced with data indicating a chronological series of accelerations of the fishing craft FS. This replacement is available because the data indicating a chronological series of accelerations of the fishing craft FS is also correlated with the conditions whether the fishing craft FS is during travel or fishing operation and with the details of the fishing operations of the fishing craft FS, like the detected angular speed data SA and the detected velocity data SV.

Figure 17:
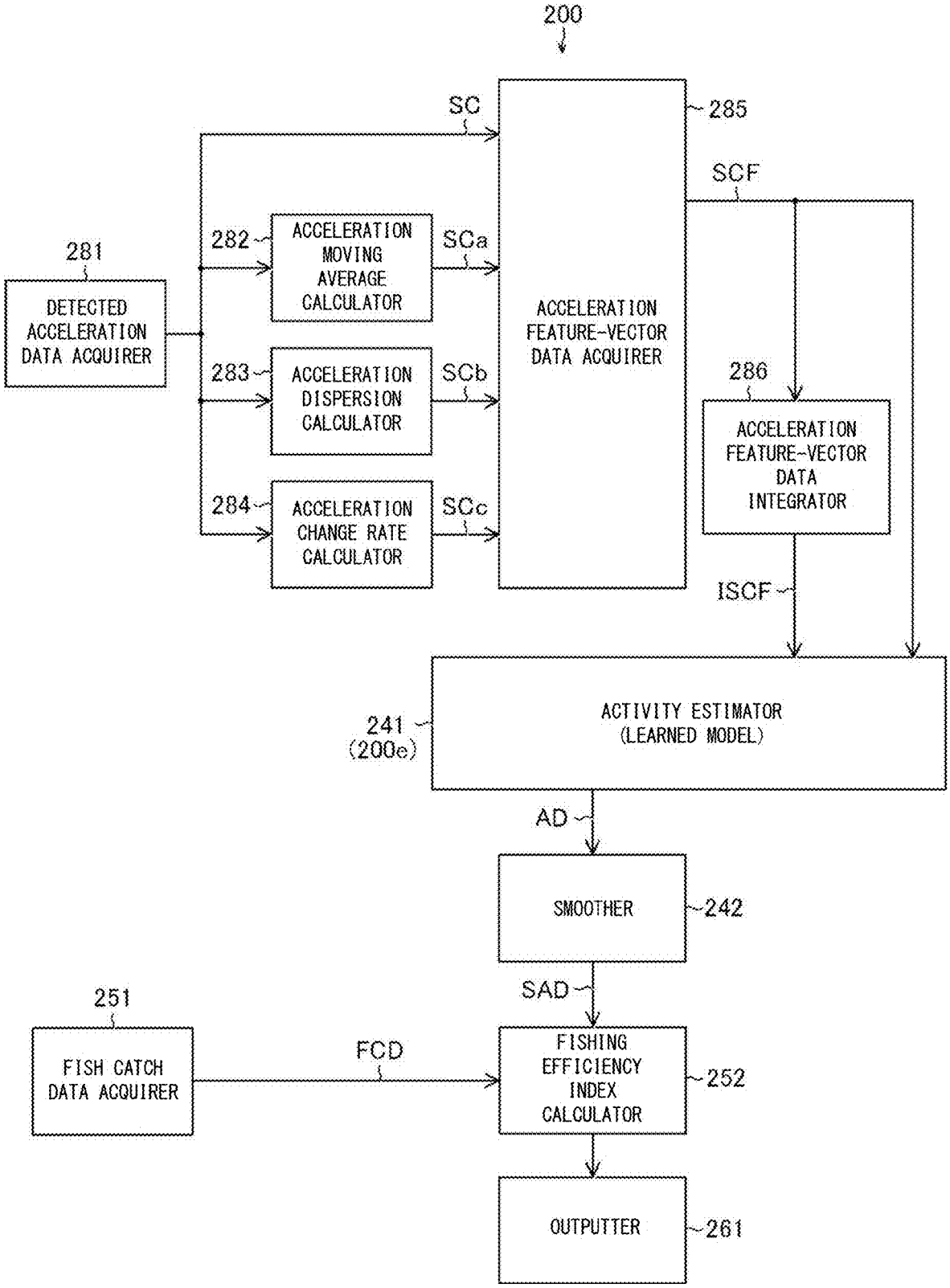
FIG. 17 is a conceptual diagram illustrating a part of the functions of a fishing-craft activity estimating apparatus according to Embodiment 5.

As illustrated in FIG. 17, the fishing-craft activity estimating apparatus 200 according to another embodiment includes a detected acceleration data acquirer 281 that acquires detected acceleration data SC. The detected acceleration data SC indicates a chronological series of detected accelerations of the fishing craft FS. The detected acceleration data acquirer 281 acquires the detected acceleration data SC from an acceleration sensor, which is not illustrated but installed in the fishing craft FS.

The fishing-craft activity estimating apparatus 200 also includes an acceleration moving average calculator 282 that generates, from the detected acceleration data SC, smoothed acceleration data SCa, which is the detected acceleration data SC after moving average.

The interval of moving average of the accelerations (hereinafter referred to as "acceleration moving average interval") is at least five times and at most twenty times as long as the sampling period of the detected acceleration data SC, for example. Specifically, the sampling period of the detected acceleration data SC is 30 seconds, and the length of the acceleration moving average interval is 300 seconds.

The fishing-craft activity estimating apparatus 200 further includes an acceleration dispersion calculator 283 that generates, from the detected acceleration data SC, acceleration dispersion data SCb indicating a chronological series of dispersions of the accelerations of the fishing craft FS.

The acceleration dispersion calculator 283 calculates, for each of acceleration dispersion calculation intervals preliminarily defined in the detected acceleration data SC, an acceleration dispersion indicating a dispersion of the accelerations. The acceleration dispersion calculator 283 repetitively calculates acceleration dispersions, while shifting the acceleration dispersion calculation interval along the temporal axis by the sampling period of the detected acceleration data SC, as in the calculation of moving average. That is, the acceleration dispersion data SCb indicates a chronological series of acceleration dispersions.

The acceleration dispersion calculation interval is at least five times and at most twenty times as long as the sampling period of the detected acceleration data SC, like the interval of the moving average, for example. In this embodiment, the acceleration dispersion calculation interval has a length equal to that of the acceleration moving average interval.

Examples of the acceleration dispersions include standard deviation, variance, fluctuation coefficient, sum of the differences from the average in all the intervals, and sum of the ratios to the average in all the intervals. The acceleration dispersions are standard deviations in this embodiment.

The fishing-craft activity estimating apparatus 200 also includes an acceleration change rate calculator 284 that generates, from the detected acceleration data SC, acceleration change rate data SCc indicating a chronological series of rates of change in the accelerations of the fishing craft FS.

The acceleration change rate calculator 284 calculates, for each of acceleration change-rate calculation intervals preliminarily defined in the detected acceleration data SC, a rate of change in the accelerations. The acceleration change rate calculator 284 repetitively calculates rates of change in the accelerations, while shifting the acceleration change-rate calculation interval along the temporal axis by the sampling period of the detected acceleration data SC, as in the calculation of moving average. That is, the acceleration change rate data SCc indicates a chronological series of rates of change in the accelerations.

The acceleration change-rate calculation interval is at least five times and at most twenty times as long as the sampling period of the detected acceleration data SC, like the interval of the moving average, for example. In this embodiment, the acceleration change-rate calculation interval has a length equal to that of the acceleration moving average interval.

The rates of change in the accelerations in this embodiment are each the inclination of a linear line segment depicted through linear approximation of fluctuations of the detected acceleration data SC in the acceleration change-rate calculation interval by the method of least squares. Alternatively, the rates of change in the accelerations may each be the average of the differences between two detected values adjacent in the temporal axis within the acceleration change-rate calculation interval, for example.

The detected acceleration data SC, the smoothed acceleration data SCa, the acceleration dispersion data SCb, and the acceleration change rate data SCc are hereinafter collectively referred to as "acceleration feature vector data SCF". The total of four values of the detected acceleration data SC, the smoothed acceleration data SCa, the acceleration dispersion data SCb, and the acceleration change rate data SCc at the common time point constitute the components of the acceleration feature vector data SCF at this time point. The acceleration feature vector data SCF contains a chronological series of these components.

The fishing-craft activity estimating apparatus 200 further includes an acceleration feature-vector data acquirer 285 that acquires the acceleration feature vector data SCF from the detected acceleration data acquirer 281, the acceleration moving average calculator 282, the acceleration dispersion calculator 283, and the acceleration change rate calculator 284.

The fishing-craft activity estimating apparatus 200 also includes an acceleration feature-vector data integrator 286 that applies temporal integration to the acceleration feature vector data SCF, and thus generates integrated acceleration feature-vector data ISCF indicating the acceleration feature vector data SCF after temporal integration.

In this specification, chronological data after temporal integration means a chronological series of the sums of two values adjacent in the temporal axis in the chronological data, or a chronological series of values proportional to these sums.

The acceleration feature-vector data integrator 286 applies temporal integration to each of the detected acceleration data SC, the smoothed acceleration data SCa, the acceleration dispersion data SCb, and the acceleration change rate data SCc contained in the acceleration feature vector data SCF.

In other words, the integrated acceleration feature-vector data ISCF contains the detected acceleration data SC after temporal integration, the smoothed acceleration data SCa after temporal integration, the acceleration dispersion data SCb after temporal integration, and the acceleration change rate data SCc after temporal integration. The chronological series of four types of integrated values at the common time points constitute the integrated acceleration feature-vector data ISCF.

The activity estimator 241 according to the embodiment executes the above-described activity identifying process on the basis of the acceleration feature vector data SCF and the integrated acceleration feature-vector data ISCF, and then outputs the activity identification result data AD indicating a chronological series of conditions whether the fishing craft FS is during travel or fishing operation.

The acceleration feature vector data SCF and the integrated acceleration feature-vector data ISCF are correlated with the conditions whether the fishing craft FS is during travel or fishing operation. The activity identifying process can be executed, in principle, on the basis of the acceleration feature vector data SCF and the integrated acceleration feature-vector data ISCF, instead of the velocity feature vector data SVF and the differentiated velocity feature-vector data DSVF illustrated in FIG. 10.

Also, the activity estimator 241 according to the embodiment executes the above-described fishing detail estimating process, on the basis of the acceleration feature vector data SCF, the integrated acceleration feature-vector data ISCF, and the trajectory image data TD illustrated in FIG. 10.

The acceleration feature vector data SCF and the integrated acceleration feature-vector data ISCF are correlated with the details of the fishing operation of the fishing craft FS. The fishing detail estimating process can be executed, in principle, on the basis of the acceleration feature vector data SCF and the integrated acceleration feature-vector data ISCF, instead of the velocity feature vector data SVF and the differentiated velocity feature-vector data DSVF illustrated in FIG. 10.

In this embodiment, a learned model serving as the activity estimator 241 is generated from learning acceleration feature vector data and learning integrated acceleration feature-vector data, instead of the learning velocity feature-vector data 411, the learning differentiated velocity feature-vector data 412, the learning angular-speed feature-vector data 413, and the learning differentiated angular-speed feature-vector data 414, which are the supervision data illustrated in FIG. 13.

The learning acceleration feature vector data is supervision data corresponding to the acceleration feature vector data SCF, and may be samples of the acceleration feature vector data SCF. The learning integrated acceleration feature-vector data is supervision data corresponding to the integrated acceleration feature-vector data ISCF, and may be samples of the integrated acceleration feature-vector data ISCF. The other configurations and operations are identical to those in Embodiment 3.

Embodiments 1 to 5 described above may be varied as described below.

FIG. 6C illustrates the activity estimator 241 that executes the activity identifying process and the fishing detail estimating process, on the basis of the velocity feature vector data SVF, the angular-speed feature vector data SAF, the differentiated velocity feature-vector data DSVF, and the differentiated angular-speed feature-vector data DSAF. Alternatively, the activity estimator 241 may execute the activity identifying process and the fishing detail estimating process, on the basis of the velocity feature vector data SVF and the angular-speed feature vector data SAF, without the differentiated velocity feature-vector data DSVF and the differentiated angular-speed feature-vector data DSAF.

In the case where the activity identifying process is not based on the differentiated velocity feature-vector data DSVF and the differentiated angular-speed feature-vector data DSAF, the configuration does not need the learning differentiated velocity feature-vector data 412 or the learning differentiated angular-speed feature-vector data 414 illustrated in FIG. 7. This activity identifying process, however, has a lower accuracy of identification than the activity identifying process based on data containing the differentiated velocity feature-vector data DSVF and the differentiated angular-speed feature-vector data DSAF as illustrated in FIG. 6C after the machine learning based on supervision data containing the learning differentiated velocity feature-vector data 412 and the learning differentiated angular-speed feature-vector data 414 illustrated in FIG. 7.

FIG. 17 illustrates the activity estimator 241 that executes the activity identifying process and the fishing detail estimating process, on the basis of the acceleration feature vector data SCF and the integrated acceleration feature-vector data ISCF. Alternatively, the activity estimator 241 may execute the activity identifying process and the fishing detail estimating process, on the basis of the acceleration feature vector data SCF, without the integrated acceleration feature-vector data ISCF.

Although FIG. 6A illustrates the velocity feature vector data SVF containing the velocity change rate data SVc, the velocity feature vector data SVF may exclude the velocity change rate data SVc. Although FIG. 6B illustrates the angular-speed feature vector data SAF containing the angular-speed change rate data SAc, the angular-speed feature vector data SAF may exclude the angular-speed change rate data SAc. Although FIG. 17 illustrates the acceleration feature vector data SCF containing the acceleration change rate data SCc, the acceleration feature vector data SCF may exclude the acceleration change rate data SCc.

FIG. 6A illustrates the detected velocity data SV and the smoothed velocity data SVa, as exemplary velocity data indicating the velocities. The velocity data may also be either of the detected velocity data SV and the smoothed velocity data SVa alone. That is, the detected velocity data SV or the smoothed velocity data SVa may be excluded from the components of the velocity feature vector data SVF.

FIG. 6B illustrates the detected angular speed data SA and the smoothed angular speed data SAa, as exemplary angular speed data indicating the angular speeds. The angular speed data may also be either of the detected angular speed data SA and the smoothed angular speed data SAa alone. That is, the detected angular speed data SA or the smoothed angular speed data SAa may be excluded from the components of the angular-speed feature vector data SAF.

FIG. 17 illustrates the detected acceleration data SC and the smoothed acceleration data SCa, as exemplary acceleration data indicating the accelerations. The acceleration data may also be either of the detected acceleration data SC and the smoothed acceleration data SCa alone. That is, the detected acceleration data SC or the smoothed acceleration data SCa may be excluded from the components of the acceleration feature vector data SCF.

FIG. 1 illustrates the fishing-craft activity estimating apparatus 200 installed in the fishing craft FS. The fishing-craft activity estimating apparatus 200 in this configuration is able to estimate an activity of the fishing craft FS in real time. Specifically, the fishing-craft activity estimating apparatus 200 is able to execute Steps S11 to S17 in FIG. 9 in real time. The fishing-craft activity estimating apparatus 200, however, is not necessarily installed in the fishing craft FS.

For example, the fishing-craft activity estimating apparatus 200 may be fixed at a site on the land. The fishing-craft activity estimating apparatus 200 may receive, from the fishing craft FS, the detected velocity data SV, the detected angular speed data SA, and the location data SP in real time. The fishing-craft activity estimating apparatus 200 in this modification can execute the location identifying process and the activity identifying process in real time.

Alternatively, the fishing craft FS may include a memory that can retain the detected velocity data SV, the detected angular speed data SA, and the location data SP sequentially detected in the fishing craft FS, and provide the fishing-craft activity estimating apparatus 200 with the detected velocity data SV, the detected angular speed data SA, and the location data SP retained in the memory, after the navigation of the fishing craft FS. The fishing-craft activity estimating apparatus 200 in this modification executes the location identifying process and the activity identifying process subsequently, that is, after the navigation of the fishing craft FS.

The fishing-craft activity estimating program 200*d* illustrated in FIG. 2 may be installed in a computer, such as existing smartphone or tablet, and thus cause the computer to perform the functions of the fishing-craft activity estimating apparatus 200. The fishing-craft activity estimating program 200*d* may be distributed via a communication line, or stored in a non-transitory computer-readable recording medium and then distributed.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2022-147362, filed on Sep. 15, 2022, the entire disclosure of which is incorporated by reference herein.

REFERENCE SIGNS LIST

110 Craft velocity sensor
120 Angular speed sensor
130 Location sensor
200 Fishing-craft activity estimating apparatus
200*a* Processor
200*b* Communication device
200*c* Storage device
200*d* Fishing-craft activity estimating program
200*e* Learned model
200*f* Map data
211 Location data acquirer
212 Location identifier
221 Detected velocity data acquirer
222 Velocity moving average calculator
223 Velocity dispersion calculator
224 Velocity change rate calculator
225 Velocity feature-vector data acquirer
226 Velocity feature-vector data differentiator
231 Detected angular-speed data acquirer
232 Angular-speed moving average calculator
233 Angular speed dispersion calculator
234 Angular-speed change rate calculator
235 Angular-speed feature-vector data acquirer
236 Angular-speed feature-vector data differentiator
241 Activity estimator
242 Smoother
251 Fish catch data acquirer
252 Fishing efficiency index calculator
261 Outputter
271 Trajectory image data generator
272 Trajectory image data acquirer
281 Detected acceleration data acquirer
282 Acceleration moving average calculator
283 Acceleration dispersion calculator
284 Acceleration change rate calculator
285 Acceleration feature-vector data acquirer
286 Acceleration feature-vector data integrator
300 Fishing-craft activity estimating system
400 Learned model generating device
411 Learning velocity feature-vector data
412 Learning differentiated velocity feature-vector data
413 Learning angular-speed feature-vector data
414 Learning differentiated angular-speed feature-vector data
415 Learning activity identification-result data
416 Learning trajectory image data
420 Generator
AD Activity identification result data
SAD Smoothed activity identification-result data
ESa First erroneous result
ESb Second erroneous result
FCD Fish catch data
FS Fishing craft
SA Detected angular speed data (angular speed data)
SAa Smoothed angular speed data (angular speed data)
SAb Angular speed dispersion data
SAc Angular-speed change rate data
SAF Angular-speed feature vector data
DSAF Differentiated angular-speed feature-vector data
SC Detected acceleration data (acceleration data)
SCa Smoothed acceleration data (acceleration data)
SCb Acceleration dispersion data
SCc Acceleration change rate data
SCF Acceleration feature vector data
ISCF Integrated acceleration feature-vector data
SV Detected velocity data (velocity data)
SVa Smoothed velocity data (velocity data)
SVb Velocity dispersion data
SVc Velocity change rate data
SVF Velocity feature vector data
DSVF Differentiated velocity feature-vector data
SP Location data
TA, TB Trajectory
TA1 Extremely slow segment
TB1 Outward segment
TB2 Return segment
TD Trajectory image data

The invention claimed is:

1. A fishing-craft activity estimating apparatus, comprising:

a velocity feature-vector data acquirer to acquire velocity feature vector data containing velocity data and velocity dispersion data, the velocity data indicating a chronological series of velocities of a fishing craft that performs a fishing operation in a fishery and a travel to a destination, the velocity dispersion data being data that indicates a chronological series of dispersions of the velocities of the fishing craft and in which velocity dispersions are aligned on a temporal axis, the velocity dispersions indicating the dispersions of the velocities of the fishing craft in a predetermined period; and an activity estimator to execute, based on the velocity feature vector data, an activity identifying process for identifying whether the fishing craft is during travel or fishing operation, and to output activity identification result data indicating a chronological series of identification results in the activity identifying process.

2. The fishing-craft activity estimating apparatus according to claim 1, further comprising:

a trajectory image data acquirer to acquire trajectory image data indicating a trajectory of the fishing craft during a navigation, wherein when the activity estimator estimates that the fishing craft is during fishing operation in the activity identifying process, the activity estimator further executes a fishing detail estimating process for estimating details of the fishing operation from the trajectory image data.

3. The fishing-craft activity estimating apparatus according to claim 1, further comprising:

a location data acquirer to acquire location data indicating locations of the fishing craft during a navigation; and a location identifier to execute, based on the location data and map data indicating a map, a location identifying process for identifying whether the fishing craft is located in a coastal region close to a land or an offshore region more distant from the land than the coastal region, wherein when the location identifier identifies that the fishing craft is located in the offshore region in the location identifying process, the activity identifying process is executed, and when the location identifier identifies that the fishing craft is located in the coastal region in the location identifying process, the activity identifying process is stopped.

4. The fishing-craft activity estimating apparatus according to claim 1, further comprising:

a smoother to apply smoothing to the activity identification result data output from the activity estimator, by correcting any of the identification results indicating the fishing craft during travel, if the identification result indicates a period shorter than a predetermined shortest travelling period, into an identification result indicating the fishing craft during fishing operation, and by correcting any of the identification results indicating the fishing craft during fishing operation, if the identification result indicates a period shorter than a predetermined shortest fishing period, into an identification result indicating the fishing craft during travel.

5. The fishing-craft activity estimating apparatus according to claim 1, further comprising:

a fish catch data acquirer to acquire fish catch data indicating an amount of fish catch achieved through fishing operations of the fishing craft from departure until arrival; and a fishing efficiency index calculator to calculate, based on the amount of fish catch indicated by the fish catch data and a net length of fishing periods, a fishing efficiency index indicating an efficiency of fishing, the net length of the fishing periods being equal to a sum of periods of the identification results indicating the fishing craft during fishing operation, the identification results being indicated by the activity identification result data.

6. A fishing-craft activity estimating apparatus, comprising:

an angular-speed feature-vector data acquirer to acquire angular-speed feature vector data containing angular speed data and angular speed dispersion data, the angular speed data indicating a chronological series of angular speeds of rocking motions of a fishing craft during a navigation, the angular speed dispersion data being data that indicates a chronological series of dispersions of the angular speeds and in which angular speed dispersions are aligned on a temporal axis, the angular speed dispersions indicating the dispersions of the angular speeds of the fishing craft in a predetermined period, the fishing craft performing a fishing operation in a fishery and a travel to a destination; and an activity estimator to execute, based on the angular-speed feature vector data, an activity identifying process for identifying whether the fishing craft is during travel or fishing operation, and to output activity identification result data indicating a chronological series of identification results in the activity identifying process.

7. A fishing-craft activity estimating apparatus, comprising:

an acceleration feature-vector data acquirer to acquire acceleration feature vector data containing acceleration data and acceleration dispersion data, the acceleration data indicating a chronological series of accelerations of a fishing craft that performs a fishing operation in a fishery and a travel to a destination, the acceleration dispersion data being data that indicates a chronological series of dispersions of the accelerations of the fishing craft and in which acceleration dispersions are aligned on a temporal axis, the acceleration dispersions indicating the dispersions of the accelerations of the fishing craft in a predetermined period; and an activity estimator to execute, based on the acceleration feature vector data, an activity identifying process for identifying whether the fishing craft is during travel or fishing operation, and to output activity identification result data indicating a chronological series of identification results in the activity identifying process.

8. A fishing-craft activity estimating apparatus, comprising:

a velocity feature-vector data acquirer to acquire velocity feature vector data containing velocity data and velocity dispersion data, the velocity data indicating a chronological series of velocities of a fishing craft that performs a fishing operation in a fishery and a travel to a destination, the velocity dispersion data being data that indicates a chronological series of dispersions of the velocities of the fishing craft and in which velocity dispersions are aligned on a temporal axis, the velocity dispersions indicating the dispersions of the velocities of the fishing craft in a predetermined period;

an angular-speed feature-vector data acquirer to acquire angular-speed feature vector data containing angular speed data and angular speed dispersion data, the angular speed data indicating a chronological series of angular speeds of rocking motions of the fishing craft during a navigation, the angular speed dispersion data being data that indicates a chronological series of dispersions of the angular speeds and in which angular speed dispersions are aligned on a temporal axis, the angular speed dispersions indicating the dispersions of the angular speeds of the fishing craft in a predetermined period; and an activity estimator to execute, based on the velocity feature vector data and the angular-speed feature vector data, an activity identifying process for identifying whether the fishing craft is during travel or fishing operation, and to output activity identification result data indicating a chronological series of identification results in the activity identifying process.

9. The fishing-craft activity estimating apparatus according to claim 8, wherein the activity estimator executes the activity identifying process based on, not only the velocity feature vector data and the angular-speed feature vector data, but also differentiated velocity feature-vector data and differentiated angular-speed feature-vector data, the differentiated velocity feature-vector data indicating the velocity feature vector data after temporal differentiation, the differentiated angular-speed feature-vector data indicating the angular-speed feature vector data after temporal differentiation.

10. The fishing-craft activity estimating apparatus according to claim 9, wherein the activity estimator includes a learned model generated by machine learning for identifying whether the fishing craft is during travel or fishing operation, the machine learning being based on the velocity feature vector data, the angular-speed feature vector data, the differentiated velocity feature-vector data, and the differentiated angular-speed feature-vector data.

11. The fishing-craft activity estimating apparatus according to claim 8, wherein the velocity feature vector data contains velocity change rate data indicating a chronological series of rates of change in the velocities of the fishing craft, and the angular-speed feature vector data contains angular-speed change rate data indicating a chronological series of rates of change in the angular speeds.

12. The fishing-craft activity estimating apparatus according to claim 8, wherein the velocity data contains detected velocity data indicating a chronological series of detected velocities of the fishing craft, and smoothed velocity data being the detected velocity data after moving average, and the angular speed data contains detected angular speed data indicating a chronological series of detected angular speeds, and smoothed angular speed data being the detected angular speed data after moving average.

13. A fishing-craft activity estimating program configured to cause a computer to function as:

a velocity feature-vector data acquirer to acquire velocity feature vector data containing velocity data and velocity dispersion data, the velocity data indicating a chronological series of velocities of a fishing craft that performs a fishing operation in a fishery and a travel to a destination, the velocity dispersion data being data that indicates a chronological series of dispersions of the velocities of the fishing craft and in which velocity dispersions are aligned on a temporal axis, the velocity dispersions indicating the dispersions of the velocities of the fishing craft in a predetermined period;

an angular-speed feature-vector data acquirer to acquire angular-speed feature vector data containing angular speed data and angular speed dispersion data, the angular speed data indicating a chronological series of angular speeds of rocking motions of the fishing craft during a navigation, the angular speed dispersion data being data that indicates a chronological series of dispersions of the angular speeds and in which angular speed dispersions are aligned on a temporal axis, the angular speed dispersions indicating the dispersions of the angular speeds of the fishing craft in a predetermined period; and an activity estimator to execute, based on the velocity feature vector data and the angular-speed feature vector data, an activity identifying process for identifying whether the fishing craft is during travel or fishing operation, and to output activity identification result data indicating a chronological series of identification results in the activity identifying process.

* * * * *